US008035601B2

(12) United States Patent
Kohno et al.

(10) Patent No.: US 8,035,601 B2
(45) Date of Patent: Oct. 11, 2011

(54) IMAGE DISPLAY DEVICE

(75) Inventors: Tohru Kohno, Kokubunji (JP); Hajime Akimoto, Kokubunji (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 692 days.

(21) Appl. No.: 11/750,637

(22) Filed: May 18, 2007

(65) Prior Publication Data

US 2007/0268219 A1 Nov. 22, 2007

(30) Foreign Application Priority Data

May 19, 2006 (JP) ..... 2006-140106

(51) Int. Cl.
*G09G 3/36* (2006.01)

(52) U.S. Cl. ..... 345/98

(58) Field of Classification Search ..... 345/87–100
See application file for complete search history.

(56) References Cited

U.S. PATENT DOCUMENTS

2005/0110553 A1* 5/2005 Chin et al. ..... 327/333
2005/0270080 A1* 12/2005 Kida et al. ..... 327/333

FOREIGN PATENT DOCUMENTS

CN 1552124 A 12/2004
JP 2000-187994 7/2000
JP 2003-115758 4/2003
JP 2003-283326 10/2003
JP 2004-228879 8/2004
JP 2004228879 A * 8/2004

* cited by examiner

*Primary Examiner* — Kevin Nguyen
*Assistant Examiner* — Waseem Moorad
(74) *Attorney, Agent, or Firm* — Miles & Stockbridge P.C.

(57) ABSTRACT

The present invention provide an image display device including a level shift circuit not requiring a clock signal nor a control signal from the outside and operating at a low voltage and ensuring a high yield.

The level shift circuit comprises a pair of transistors each having a source electrode connected to a power, a gate electrode and a drain electrode (the gate electrode and the drain electrode of one of the transistors being connected with the drain electrode and the gate electrode of the other (cross coupling)); and transistors each having an a source electrode connected to a low voltage source or the ground, a drain electrode connected to a connection point for the cross coupling, and a gate electrode, one of the gate electrodes being connected to an input signal and the other being connected to an input inversion signal. The level shift circuit has also a transistor having a gate electrode connected to a connection point for the cross-coupling, a drain electrode connected to a connection point for cross-coupling forming a pair with the cross-coupling connection point, and a source electrode, one of the source electrodes being connected to an input signal and the other being connected to an input inversion signal. The transistor with at least the gate electrode connected to the cross-coupling connection point is a TFT formed on an insulating substrate.

14 Claims, 16 Drawing Sheets

IMAGE DISPLAY DEVICE

CLAIM OF PRIORITY

The present application claims priority from Japanese application JP 2006-140106 filed on May 19, 2006, the content of which is hereby incorporated by reference into this application.

BACKGROUND OF THE INVENTION

1. Field of the Invention

The present invention relates to an image display device using a liquid crystal element, an organic EL (Electro Luminescence) element, or the like, and more specifically to an image display device having a level shift circuit in an output section of a drive circuit.

2. Description of the Related Art

An image display panel using a liquid crystal element, an organic EL element, or the like includes a TFT (Thin Film Transistor) formed on a transparent board and has a pixel circuit configured with the TFT element, a data driver, a gate driver, and a protection circuit. A control signal for driving the data driver and the gate driver is transmitted from an external system via an FPC (Flexible Printed Card) to inside of the image display panel, while a data signal transmitted to the pixel circuit is further transmitted via a driver IC to inside of the image display panel.

Here, there is a problem that an operating voltage for an external system is different from that for the TFT circuit prepared inside the image display panel. (Generally, the operating voltage for the TFT circuit inside an image display panel is higher than that for an external system). To overcome this problem, a voltage level for a control signal such as a gate driver control signal or a data driver control signal is changed from an operating voltage for the external system to that for the TFT circuit inside a panel by using a level shift circuit formed with a mono-crystalline silicon transistor formed on the external system or a level shift circuit formed with a TFT inside the image display panel. A driver IC is subjected to level change in the output stage.

FIG. 11 illustrates a general configuration of a level shift circuit provided outside a display panel in an image display module which is currently produced (The configuration is disclosed, for instance, in JP-A-2003-283326). This circuit actuates a gate of an NMOS transistor NM7 by applying an input signal via an inverter INV1 and an inverter INV2 to the gate of the NMOS transistor NM7, and also actuates a gate of an NMOS transistor NM8 by applying an inversion signal for the input signal via the inverter INV1 to the gate of the NMOS transistor NM8.

In the following description, it is assumed that the NMOS transistor NM7 and the PMOS transistor PM8 are non-conductive to each other and also that the NMOS transistor NM8 and a PMOS transistor PM7 are conductive to each other. When an input signal voltage rises and surpasses a threshold value for the NMOS transistor NM7, the NMOS transistor NM7 is set in the conducting state. When an inversion signal voltage for an input voltage falls and becomes lower than a threshold value for the NMOS transistor NM8, the NMOS transistor NM8 is set in the non-conducting state. In this step, since the PMOS transistor PM7 is in the conducting state, a potential at a node ND9 is decided according to a conduction resistance ratio between the NMOS transistor NM7 and the PMOS transistor PM7.

When this potential falls down to a level lower than the threshold value for the PMOS transistor PM8 and the PMOS transistor PM8 is set in the conducting state, a value at the node DN10 rises toward a H (high) level voltage (H level voltage in the figure is VDD2), so that the PMOS transistor PM7 is set in the non-conducting state and a value at a node ND9 falls toward a L (low) level voltage (level voltage in the figure is a ground potential (GND)). Namely, the circuit functions as a level shift circuit which converts a low amplitude signal transmitted from a circuit using a low power voltage VDD1 to a high amplitude signal and transmits the high amplitude signal to a circuit using a high power voltage VDD2.

The level shift circuit shown in FIG. 11 is excellent in high speed operation and low current consumption although the level shift circuit has a small number of transistors. In addition, voltages applied to a source and a back gate of a transistor constituting the circuit shown in FIG. 11 are always kept equal, so that a parasitic diode D1 shown in FIG. 5B illustrating a cross-sectional structure of an NMOS transistor expressed with a transistor symbol in FIG. 5A or a parasitic diode D2 as shown in FIG, 7B illustrating a cross-sectional structure of a PMOS transistor expressed by a transistor symbol in FIG. 7A is always kept OFF, so that the substrate bias effect is never generated. Because of the feature, the level shift circuit is also excellent in operations at a low temperature, and is one of monocrystal silicon circuits which are most generally used.

The circuit shown in FIG. 12A is disclosed in JP-A-2000-187994. This circuit is configured with a thin film transistor (TFT). Applied to a gate electrode of a NMOS transistor NM13 is a voltage at the node 12 decided according to a conduction resistance ratio between a NMOS transistor NM10 and a PMOS transistor PM10. Applied to a gate electrode of a NMOS transistor NM14 is a voltage at a node ND11 decided according to a conduction resistance ratio between a NMOS transistor NM9 and a PMOS transistor PM9. When the NMOS transistor NM9 is shifted from the non-conducting state to the conducting state, also the NMOS transistor NM13 is shifted from the non-conducting state to the conducting state. When the NMOS transistor NM10 is shifted from the non-conducting state to the conducting state, also a NMOS transistor NM14 is shifted from the non-conducting state to the conducting state. These shifting operations occur alternately.

Conductivity resistance of a NMOS transistor is decided by the NMOS transistor NM9 and the lower cabinet 13 or by the NMOS transistor NM10 and the NMOS transistor NM14. A high amplitude signal with the L level at GND and the H level at the high power voltage VDD is input to gate electrodes of the NMOS transistor NM13 and the NMOS transistor NM14, so that a circuit operation can be realized with a small gate width. Therefore the circuit can be incorporated in a panel.

The circuit shown in FIG. 13 is formed with a monocrystal silicon semiconductor. In the circuit shown in FIG. 13, a voltage at the node 13 decided by a conduction resistance ratio between a NMOS transistor NM17 and a PMOS transistor PM11 is applied to a gate electrode of a NMOS transistor NM19, while a voltage at a node ND14 decided by a conduction resistance ratio between a NMOS transistor 18 and a PMOS transistor PM12 is applied to a gate electrode of a NMOS transistor NM20.

When the NMOS transistor NM17 is shifted from the non-conducting state to the conducting state, also a NMOS transistor NM 20 is shifted from the non-conducting state to the conducting state, while, when the NMOS transistor 18 is shifted from the non-conducting state to the conducting state, also a NMOS transistor NM19 is shifted from the non-conducting state to the conducting state, and there operations occur alternately. In this circuit, even when the circuit is in the initial state and the capability to drive the NMOS transistor NM17 and the NMOS transistor 18 is small, a difference is generated between a voltage appearing at the node ND 13 and that appearing at the node ND14, so that the circuit operates regularly. As an example of the level shift circuit having the configuration as described above is disclosed, for instance, in JP-A-2004-228879.

FIG. 14 illustrates a level shift circuit described in JP-A-2003-115758. This circuit realizes level shift by using the principle of a charge pump. This circuit requires a clock signal CLK and an inversion signal /CLK, and is configured with a TFT circuit. Because of the circuit configuration, when the circuit is formed with a monocrystal silicon semiconductor, a NMOS transistor NM23 is affected by the substrate bias effect. An input signal is received via a transistor NM21 for switching at a gate terminal of a NMOS transistor NM22, so that it is necessary to hold a threshold voltage for the NMOS transistor NM22 at a low level for raising a voltage of an input signal at a low voltage. When the circuit is formed with a TFT, a limit for operations at a low voltage is decided by a threshold value for the TFT, but since there is no influence by the substrate bias effect even when the NMOS transistor NM22 is replaced with a monocrystal silicon semiconductor having a lower threshold value that that for the TFT, it is considered that operations at a low voltage can be realized by the replacement.

However, there are several problems in the general level sift circuit shown in FIG. 11. Voltages at a node DN9 and a node ND10 is decided by a ratio between a conduction resistance of the NMOS transistor and that of the PMOS transistor, namely a ratio of drive capabilities of the two transistors.

In the PMOS transistors PM7 and PM8, a voltage at the source electrode is fixed at the high power voltage VDD2, and a high amplitude signal with the L level at GND and the H level at the high power voltage DD2 is input, while, in the NMOS transistors NM7 and NM8, a voltage at the source electrode is fixed at the GND voltage, and a low amplitude signal with the L level at the GND and the H level at the lower power voltage VDD1 is input to the gate electrode, and therefore in the monocrystal silicon semiconductor in which the lower power voltage VDD1 has been becoming more and more lower, or in the TFT circuit in which a threshold value Vth is large, a difference between voltages applied to the gate electrode and the source electrode is large, so that the capability for driving the NMOS transistors NM7 and NM8 is low. In this case, conduction resistance of the NMOS transistor becomes lower, and the PMOS transistor PM8 is not shifted by a voltage at the node ND9 from the non-conducting state to the conducting state, or the PMOS transistor PM7 is not shifted from the non-conducting state to the conducting state by the voltage at the node ND10. To set the ratio of driving capabilities at a proper level so the PMOS transistor PM8 properly operates even with high frequency waves, it is necessary to make a gate width of the NMOS transistor larger than that of the PMOS transistor.

The characteristic line shown in FIG. 15 represents sizes of the NMOS transistors NM1, NM2 required for quadrupling output for the VDD 1 of 2.5 V and for the VDD 2 of 10 V under the conditions in which a threshold voltage Vth for the transistor is 1 V and a load of 0.1 pF is applied to an output terminal of the level shift circuit. In FIG. 15, the horizontal axis represents an operating frequency [MHz] and the vertical axis represents a ratio of a channel length L of a MOS transistor and a channel width W thereof (W/L). For instance, for the NMOS transistor to operate at a frequency of 50 MHz, the transistor size expressed by W/L is required to be 490/4 or more. TO achieve the requirement above, an area of the input circuit section becomes larger, which disadvantageously drops the yield.

In the circuit shown in FIG. 12A (JP-A-2003-283326), in the state where the clock signal CK is fixed at the H level and the NMOS transistors NM11 and NM12 are always conducted to each other, if drive capabilities of the NMOS transistor NM9 and the NMOS transistor NM10 are small, the conduction resistance is high in both the NMOS transistor NM9 and the NMOS transistor NM10 and a voltage difference is not generated between a voltage at the node ND11 and the node ND12, so that both the NMOS transistor NM13 and the NMOS transistor NM14 are set in the conducting state, and both the voltage at the node ND11 and the voltage at the node ND12 drop to the L level, which sometimes disable operations of the circuit. To prevent occurrence of this problem, a control signal for a clock signal CK from the outside as well as for an inversion signal /CK is used, and the circuit is run correctly by transmitting the signals CK and /CK to prevent both the voltage at the node ND11 and the voltage at the node ND12 from dropping to the L level due to influence by the NMOS transistors NM15 and NM16 even when both the NMOS transistors NM13 and NM14 are in the conducting state.

In the circuit configuration shown in FIG. 12B, it is disadvantageously required to employ the clock signal CK from the outside and the inversion signal /CK. In order to lower conduction resistances in the NMOS transistors NM9, NM11, NM13 and NM 15 or in the NMOS transistors NM10, NM12, NM14 and NM16 and to set a ratio of the drive capabilities at the optimal value, it is necessary that amplitudes of the clock signal CK and the clock inversion signal /CK should be large, and therefore it is difficult to apply the circuit configuration to a TFT circuit having a large threshold value or a circuit requiring an input signal with low voltage and small amplitude.

Since the circuit shown in FIG. 13 is formed with a monocrystal silicon semiconductor, the circuit is affected by the substrate bias effect, and threshold values for the NMOS transistors NM19 and the NMOS transistor NM20 increase, so that sufficient drive capabilities are not generated, and the conduction resistance decided by a combination of the NMOS transistor NM17 and the NMOS transistor NM20 or by a combination of the NMOS transistor 18 and the NMOS transistor NM19 does not drop sufficiently, which is another problem to be solved.

The characteristic line F13_1 shown in FIG. 15 represents sizes of the NMOS transistors NM17, NM18 required when the ratio of a channel width W versus a channel length L (W/L) is 4/4, the work function ($2\phi F$) is equal to 0.7, the substrate bias effect coefficient $\gamma$ is 0.3, and outputs for the VDD1 of 2.5 V and for the VDD2 of 10 V is to be quadrupled under the conditions in which a threshold value Vth for the transistor is 1 V and a load of 0.1 pF is applied to an output terminal of the level shift circuit. For instance, to operate with a frequency of 50 MHz, the transistor size W/L of 450/4 or more is required. The horizontal axis in FIG. 15 represents an operating frequency f [MHz].

The characteristic line F13_2 shown in FIG. 16 represents sizes of the NMOS transistor NM19 and the NMOS transistor NM20 when operating at a frequency of 50 MHz under the same conditions as those described above. Even when a transistor size as expressed by W/L of each of the NMOS transistor NM19 and the NMOS transistor NM20 is 16/4, the transistor size W/L is required to be 300/4 or more. To overcome the problem, the NMOS transistor NM17 and the NMOS transistor 18 are replaced with PMOS transistors to avoid the influence by the substrate bias effect. However, since there is still the problem that a drive capability of the PMOS transistor is smaller as compared to that of the NMOS transistor and cannot supply a sufficient voltage to a section between a gate and a source of the PMOS transistor. Also, in a low voltage monocrystal silicon semiconductor circuit or in a TFT circuit having a large threshold value, the problem relating to the necessity for a large area is not solved, and also the problem of low yield still remains.

In the circuit configuration shown in FIG. 14, the operating speed is decided by the conduction resistance of a NMOS transistor NM21 and a time constant for a capacitor C1, and is limited by a threshold value for the NMOS transistor NM21. When the NMOS transistor NM21 is replaced with a monocrystal silicon semiconductor, influence by the substrate bias effect is generated, and the effect of the replacement cannot be expected.

SUMMARY OF THE INVENTION

An object of the present invention is to realize an image display device ensuring high yield with a simple configuration by incorporating a low voltage/high operating speed level shift circuit not requiring a clock signal from outside nor a control signal in an LSI chip or a panel.

Another object of the present invention is to provide a low cost image display device ensuring a high yield with a simple configuration by incorporating a low voltage/high operating speed level shift circuit not requiring a clock signal from outside nor a control signal in the LSI chip or the panel.

An example of a representative means in the present invention disclosed in this specification is as described below. Namely, the image display device according to the present invention includes a first PMOS transistor and a second PMOS transistor. A source electrode of each of the PMOS transistors is connected to a power voltage, and a gate of each PMOS transistor is connected to a drain electrode of the other PMOS transistor. The image display device also includes a first NMOS transistor, a second NMOS transistor, a third NMOS transistor, and a fourth NMOS transistor. The first NMOS transistor has a source electrode connected to the ground, a drain electrode connected to a drain electrode of the first PMOS transistor, and a gate electrode connected to an input terminal. The second NMOS transistor has a source electrode connected to a reference voltage, a drain electrode connected to a drain electrode of the second PMOS transistor, and a gate electrode connected to an input reversing terminal. The third NMOS transistor has a gate electrode connected to the drain electrodes of the first NMOS transistor and the first PMOS transistor, and has a source electrode and a drain electrode connected to the gate electrode of the first NMOS transistor and the drain electrode of the second NMOS transistor, respectively. The fourth NMOS transistor has a gate electrode connected to the drain electrodes of the second NMOS transistor and the second PMOS transistor, and a source electrode and a drain electrode connected to the gate electrode of the second NMOS transistor and to the drain electrode of the first NMOS transistor, respectively. The image display device has a level shift block including a plurality of level shift circuits in which at least each of the third NMOS transistor and the fourth NMOS transistor is formed on an insulating substrate, a pixel section in which a plurality of pixels are arranged in a matrix form, a gate drive section for generating signals for scanning each pixel, and a data driver section for supplying a video signal to each pixel.

The present invention can provide an image display device ensuring a high yield with simple configuration and having a low voltage/high operating speed level shift circuit incorporated in an LSI chip or a panel thereof.

DESCRIPTION OF SYMBOLS

Figure 1:
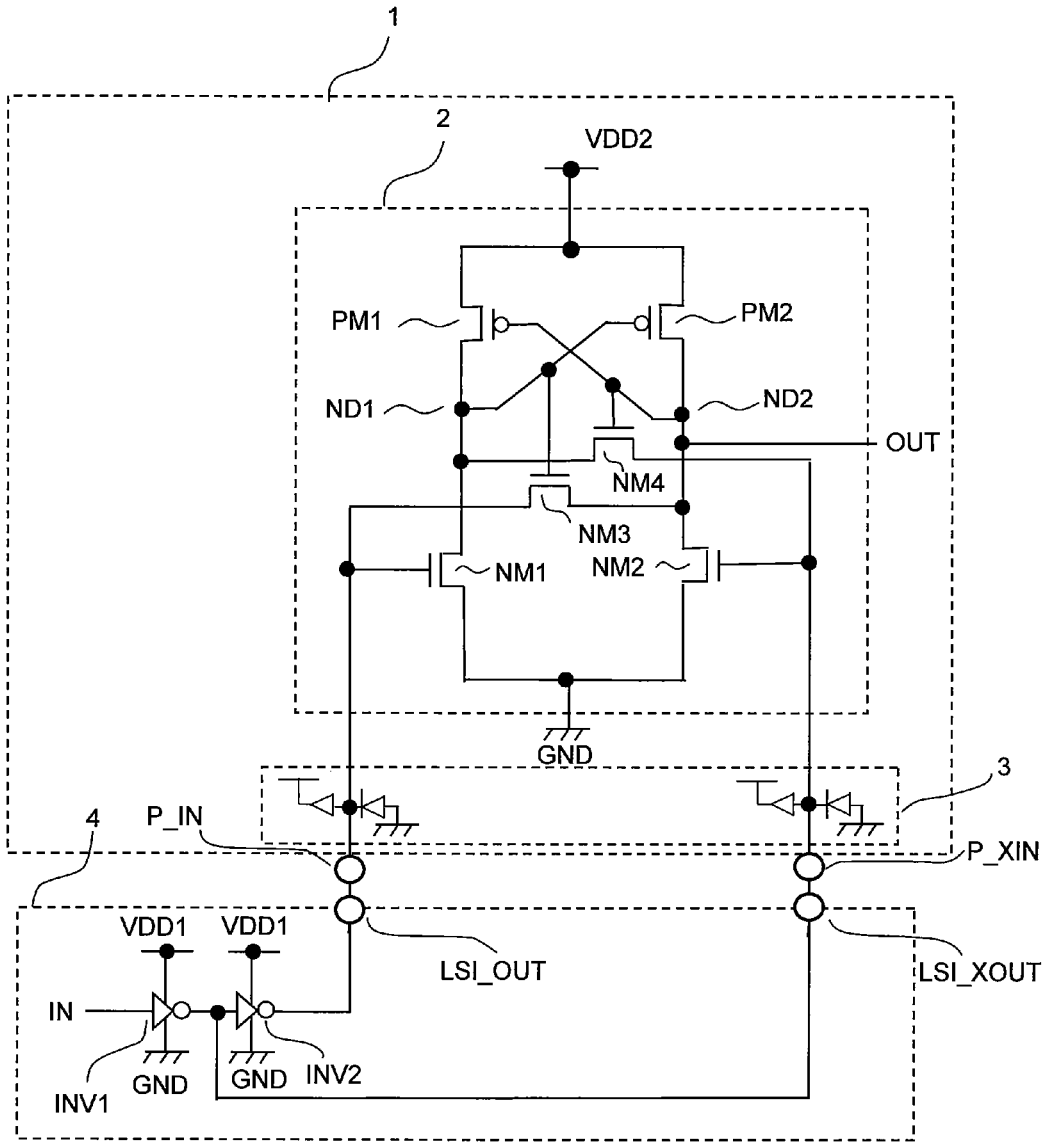
FIG. 1 is a block diagram illustrating a first level shift circuit used in an image display device according to the present invention.

1, 5 . . . Panel side
2, 6 . . . Level shift circuit block
3, 7 . . . Protection circuit
4 . . . External system side
30 . . . Panel
31 . . . External system side
33 . . . LSI chip
NM1-24 . . . NMOS transistor
PM1 to MP14 . . . PMOS transistor
P_IN, P_XIN, LSI_OUT, LSI_XOUT, D1_IN, D1_OUT, D2_IN,
D2_OUT . . . Terminal
INV1, INV2 . . . Inverter
VDD1, VDD2, VSS1, VSS2, V_oled . . . Voltage
IN . . . Input
OUT . . . Output
GND . . . Ground (ground potential)
G . . . Gate electrode
S . . . Source electrode
D . . . Drain electrode
B . . . Back gate electrode
G_DRV . . . Gate driver
DT_DRV . . . Data driver
LS_BLK . . . Level shift block
ESD_BLK . . . Protection circuit block
PIX_BLK . . . Pixel block
LIQ_PIX . . . Liquid crystal pixel
OLED_PIX . . . Organic EL pixel
Sw_Tr1, Sw_Tr2, Drv_T2 . . . Transistor
C_oled . . . Capacitor
OELD . . . Organic EL element
LIQ . . . Liquid crystal
T19, T24 . . . Terminal

BEST MODE FOR CARRYING OUT THE INVENTION

Embodiments of the present invention are described in detail below with reference to the related drawings.

First Embodiment

Figure 9A:
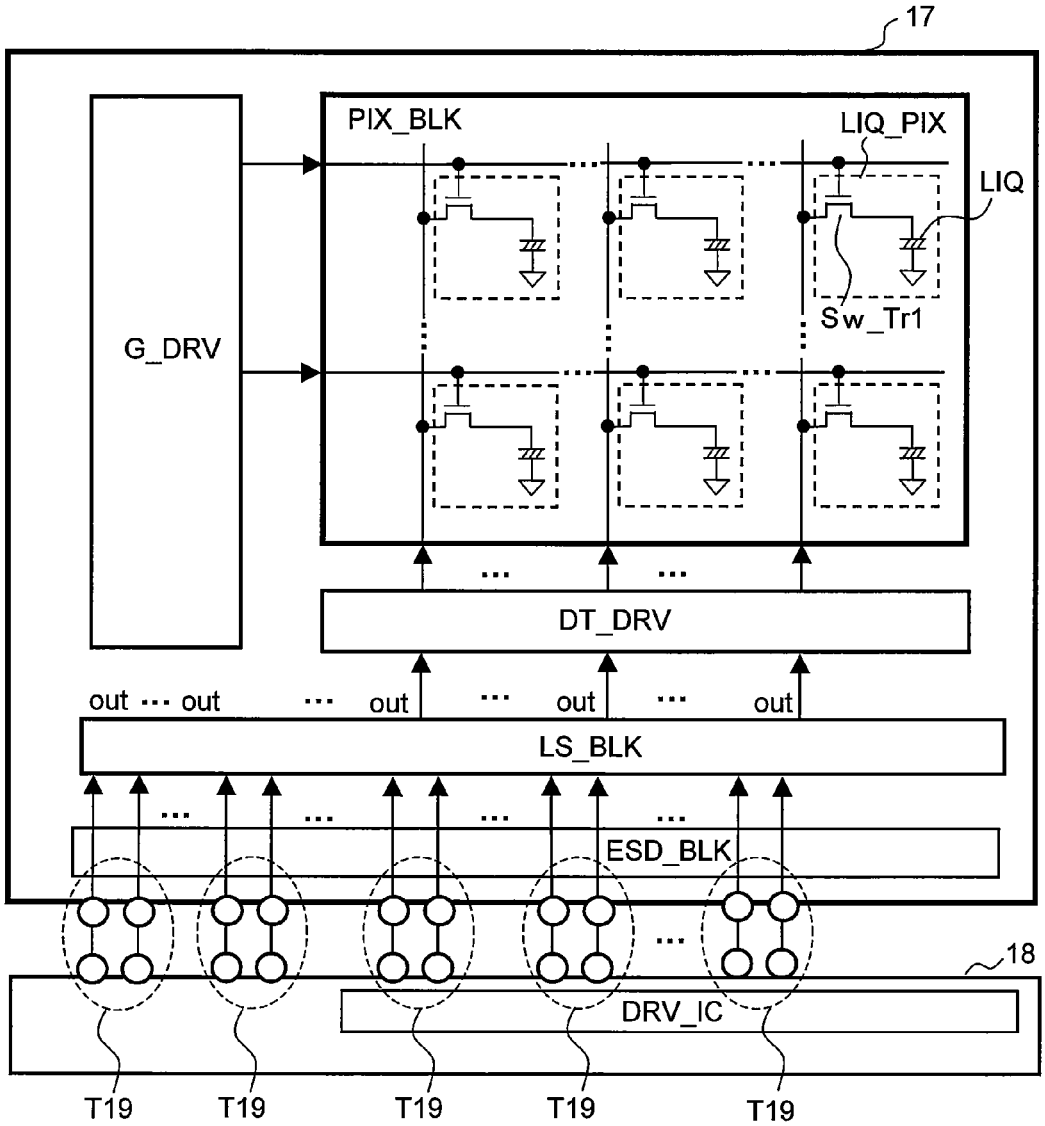
FIG. 9A is a block diagram of a liquid crystal image display device according to first and second embodiments of the present invention.

FIG. 9A is a circuit block diagram illustrating an embodiment in which a first level shift circuit having the configuration as shown in FIG. 1 is applied to a level shift circuit block LS_BLK of a liquid crystal image display system. At first, the level shift circuit shown in FIG. 1 is described. In FIG. 1, Reference numeral 1 denotes a panel side of an image display system; 2, a level shift circuit block; 3, a protection circuit block; and 4, an external system side. An input signal IN, which is transmitted from an external system and based on the ground potential (GND) as the L level and VDD1 as the H level, is input into an inverter INV1. Inverted output of the input signal IN which is output from the INV1 is input into an inverter INV2, and also to an LSI_XOUT terminal. Output from the INV2 is input from the external system side LSI_OUT terminal via the terminal P_IN into inside of the panel, while output from the INV1 is input from the LSI_XOUT terminal via the terminal P_XIN into inside of the panel.

All elements including NMOS transistors NM1 to NM4 constituting a level shift circuit block 2 inside the panel and PMPS transistor PM1, PM2 are TFT elements formed on a glass substrate. The level shift block 2 includes a pair of PMOS transistors PM 1 and PM2 each having a source electrode connected to the power voltage VDD 2, a gate electrode and a drain electrode. The gate electrode and the drain electrode of the PMOS transistor PM1 are cross coupled to the drain electrode and the gate electrode of the PMOS transistor PM2, respectively. The level shift block 2 also includes NMOS transistors NM1, NM2 each having a source electrode connected to a lower voltage source or the ground (GND shown in FIG. 1) and a drain electrode connected to a connection point for the cross-coupling. One of gate electrodes of the NMOS transistors is connected with an input terminal and the other is connected with an input inverting terminal. The level shift block 2 also includes NMOS transistors NM3, NM4 each having a gate electrode connected to a connection point for the cross-coupling and a drain electrode connected to a connection point for the cross coupling. One of source electrodes of the NMOS transistors is connected with the input terminal and the other is connected with the input inverting terminal. This first level shift circuit block is formed within a voltage range with the L level at the ground (GND) and the H level at the VDD2. The VDD1 is lower than the VDD2 (VDD1<VDD2).

Operations of the first level shift circuit are described below. The first level shift circuits operated by applying an input signal IN to the gate electrode of the NMOS transistor NM1 and an inversion signal for the input signal NM1 to the gate electrode of the NMOS transistor NM2. In the following description, it is assumed that the NMOS transistor NM1 and the PMOS transistor 2 are not conducted to each other and the NMOS transistor NM2 and the PMOS transistor PM1 are conducted to each other in the initial state.

When a voltage according to an input signal rises and surpasses a threshold value for the NMOS transistor NM1, the NMOS transistor NM1 is set in the conducting state. At the same time, when a voltage according to an inversion signal for the input voltage falls and drops below a threshold value for the NMOS transistor NM2, the NMOS transistor NM2 is set in the not-conducting state. Since the PMOS transistor PM2 is shifted to the conducting state according to a voltage decided by a conduction resistance ratio between the NMOS transistor NM1 and the PMOS transistor PM1. In association with this level shifting, a voltage at the node ND2 decided by a conduction resistance ratio between the NMOS transistor NM2 and the PMOS transistor PM2 is applied to the gate electrode of the NMOS transistor NM4, and a voltage according to an inversion signal of the input signal is applied to the source electrode of the NMOS transistor NM4.

Since the NMOS transistor is in the not-conducting state at this point of time, a voltage applied to the gate electrode of the NMOS transistor NM4 is sufficiently large and the input inversion signal is falling, the voltage applied to the source electrode of the NMOS transistor NM4 is sufficiently small. Therefore, a sufficiently large voltage can be supplied to a section between the gate electrode and the source electrode of the NMOS transistor NM4.

Figure 5A:
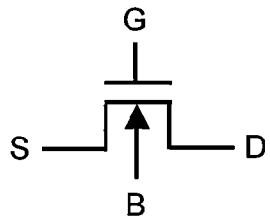
FIG. 5 is a view illustrating a cross-sectional structure of a monocrystal silicon semiconductor used for the image display device according to the present invention with a NMOS transistor symbol.
Figure 5B:
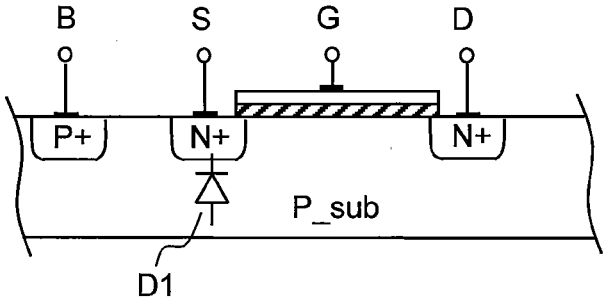
Figure 6A:
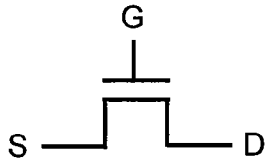
FIG. 6 is a view illustrating a TFT used for the image display device according to the present invention with a NMOS transistor symbol.
Figure 6B:
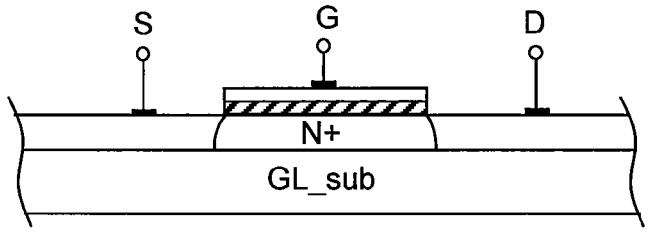

Since the NMOS transistor NM4 is a TFT device formed on a glass substrate (GL_sub) which is an insulating body as shown in FIG. 6B illustrating a cross-sectional structure of the transistor shown in FIG. 6A, a parasitic diode D1 formed between the P type substrate (P_sub) and the N+source (S) as shown in FIG. 5B is not present, and therefore the NMOS transistor NM4 is not affected by the substrate bias effect. Because of the feature, NMOS transistor NM4 can acquire large drive capability even with the transistor size W/L of 4/4. A potential at the node ND1 is shifted toward the L level according to a conduction resistance ratio between the NMOS transistors NM1 or NM4 and the PMOS transistor PM1 realized through the operations described above.

When the PMOS transistor is set in the conducting state ensuring a high drive capability, a voltage value at the node ND2 rises toward the H level voltage (VDD2 in FIG. 1), so that the NMOS transistor PM1 is set in the not-conducting state, and the voltage value at the node ND 1 further falls toward the L level voltage (GND in FIG. 1). When the input signal voltage falls to a level below the threshold value for the NMOS transistor NM1, the NMOS transistor NM1 is set in the not-conducting state. At the same time, when a voltage according to an inversion signal of the input signal rises and becomes higher than a threshold value for the NMOS transistor NM2, the NMOS transistor NM2 is set in the conducting state.

The PMOS transistor is shifted toward the conducting state according to a voltage at the node ND2 decided by a conduction resistance ratio between the NMOS transistor NM2 and the PMOS transistor PM2. In relation to this level shifting, a voltage at the node ND1 decided by a conduction resistance ratio between the NMOS transistor NM1 and the PMOS transistor PM1 is applied to the gate electrode of the NMOS transistor NM3, and the input signal voltage is applied to the source electrode of the NMOS transistor NM3.

Since the NMOS transistor NM1 is in the not-conducting state at this point of time, a voltage applied to the gate electrode of the NMOS transistor NM3 is sufficiently large, and the input signal falls, so that a voltage applied to the source electrode of the NMOS transistor NM3 is sufficiently small, and a sufficiently large voltage can be applied to a section between the gate electrode and the source electrode of the NMOS transistor NM3.

Furthermore, since the NMOS transistor NM3 is a TFT device formed on a glass substrate which is an insulating body as shown in FIG. 6B and is not affected by the substrate bias effect, the NMOS transistor NM3 ensures a large drive capability even with the transistor size W/L of 4/4.

A potential at the node ND2 can be shifted toward the L level according to a conduction resistance between the NMOS transistor NM2 or NM3 and the PMOS transistor PM2 realized through the operations described above. When the PMOS transistor PM1 is set in the conducting state ensuring a high drive capability, a voltage value at the node ND1 rises toward the H level voltage (VDD2 in FIG. 1), so that the PMOS transistor PM2 is set in the not-conducting state and a voltage value at the node ND2 further falls toward the L level voltage (GND in FIG. 1).

That is, the first level conversion circuit shown in FIG. 1 functions as a level shift circuit which converts a low amplitude signal transmitted from a circuit using the low power voltage VDD1 to a high amplitude signal, and transmits the high amplitude signal to a circuit using the high power voltage VDD2.

Figure 15:
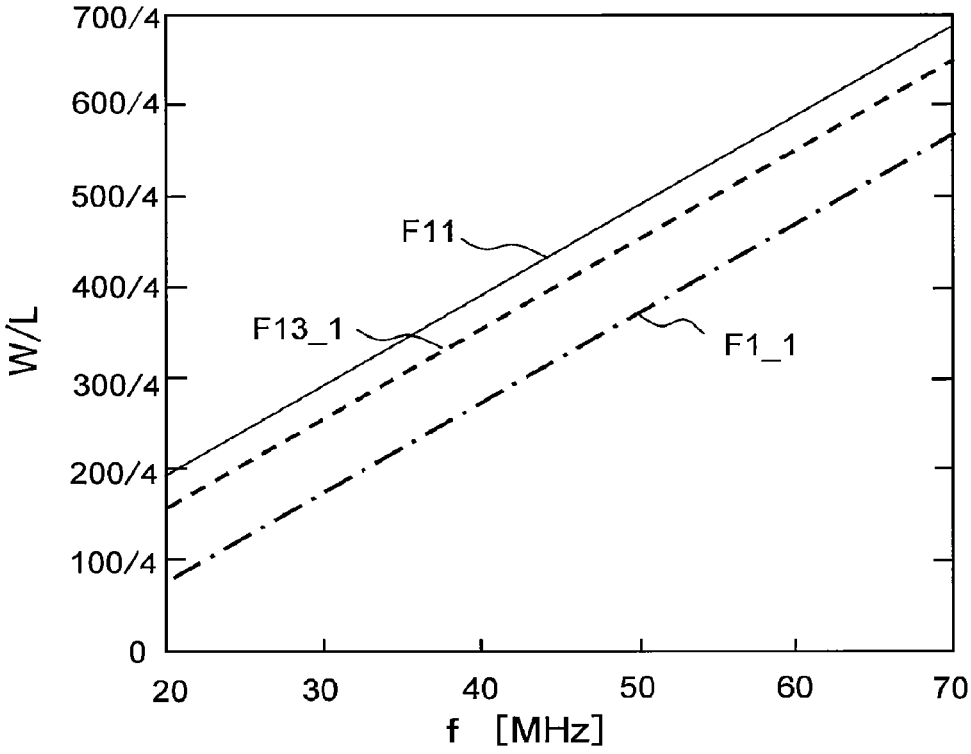
FIG. 15 is a characteristic view illustrating a comparison between a size of a transistor required in the level shift circuit shown in FIG. 1 and that required for an operating frequency of the level shift circuits shown in FIG. 11 and FIG. 13.

The characteristic line F1_1 shown in FIG. 15 represents transistor sizes required for the NMOS transistors NM1 and NM2 when the transistor size W/L of each of the NMOS transistors NM3 and NM4 is 4/4 and an output for the VDD1 of 2.5 and an output for the VDD 2 of 10 V are to be quadrupled under the conditions in which a threshold value Vth for the transistor is 1 V and a load of 0.1 pF is applied to an output terminal of the level shift circuit. The transistor size W/L of 370/4 or more is required for operations at the frequency of 50 MHz.

Figure 16:
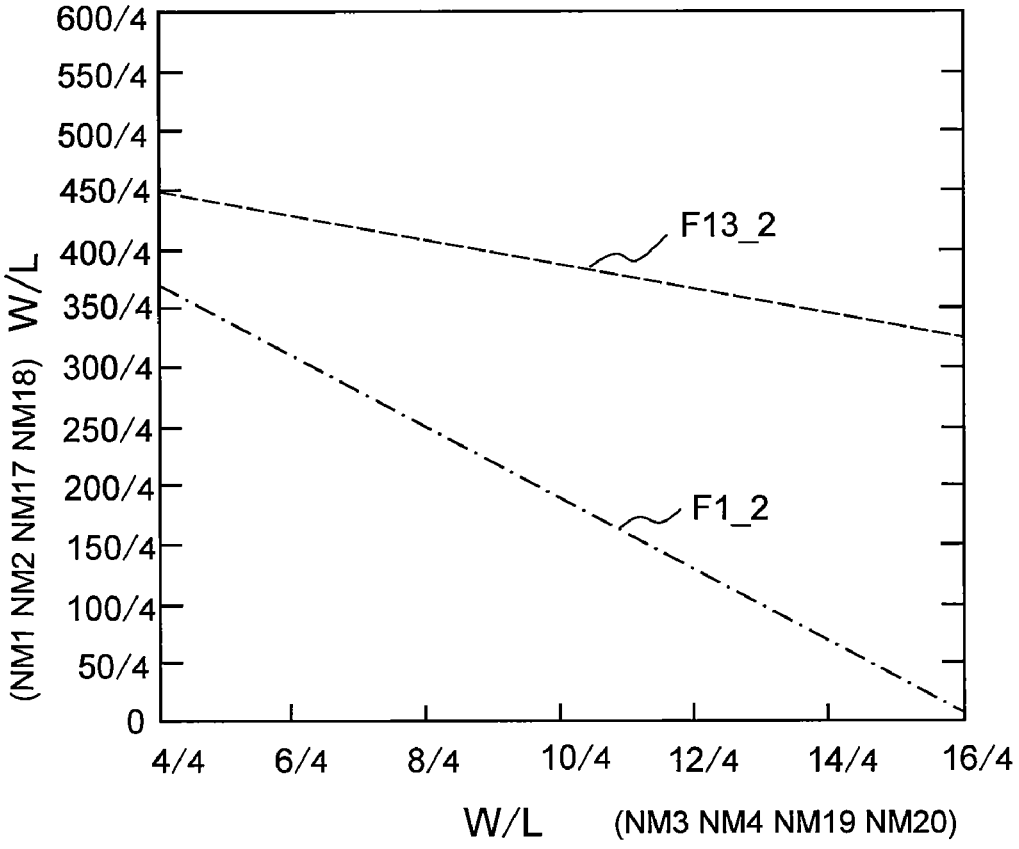
FIG. 16 is a characteristic view illustrating a comparison between a size of a transistor required in the level shift circuit shown in FIG. 1 and that required when the level shift circuit shown in FIG. 13 operates at the frequency of 40 MHz.

The characteristic line F1_2 shown in FIG. 16 represents sizes of the NMOS transistors NM1 and NM2 required in relation to transistor sizes of the NMOS transistors NM3 and NM4 for operations at the frequency of 50 MHz. When a transistor size W/L of each of the NMOS transistors NM3 and NM4 is 16/4, the NMOS transistors NM1, NM2 can operate when the size W/L is 8/4, and when the transistor size W/L of each of the NMOS transistors NM3 and NM4 is 12/4, the NMOS transistors NM1, NM2 can operate when the size W/L is 40/4. When operating at the frequency of 50 MHz, the transistor sizes W/L of the PMOS transistors PM1, PM2 are 16/4.

Therefore, the first level shift circuits operates normally when the transistor size W/L is 50/4 or below.

The first level shift circuit, which operates as described above, is described below with reference to an image display system in which the level shift circuit block LS_BLK shown in FIG. 9A is used.

Figure 7A:
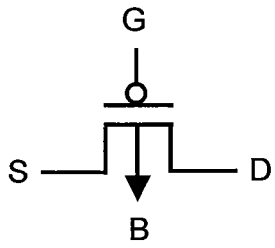
FIG. 7 is a view illustrating a cross-sectional structure of a monocrystal silicon semiconductor used for the image display device according to the present invention with a PMOS transistor symbol.

In FIG. 9A, reference numeral 17 denotes a panel side; and 18, an external system side. The panel side 17 is formed with a TFT device prepared on a glass substrate and having a gate electrode G, a source electrode S, and a drain electrode D as shown in FIGS. 6A and 6B as well as in FIGS. 8A and 8B, while the external system side 18 is formed with a monocrystal semiconductor device having a gate electrode G, a source electrode S, a drain electrode D, and a back gate electrode B as shown in FIGS. 5A and 5B as well as in FIGS. 7A and 7B.

The panel side 17 is formed with a pixel section PIX_BLK, a data driver DT_DRV, a gate driver G_DRV, and a protection circuit section ESD_BLCK, and a control signal and a data signal are transmitted from the external system to a panel. As shown in FIG. 9A, terminals of the panel 17 and terminals of the external system side 17 are connected to each other with an FPC including terminals 19 connected to that of the other side with a pair of two wirings. A data signal is transmitted via a driver IC section DRV_IC to an pixel block PIX_BLK. In the pixel block PIX_BLK, pixels LIQ_PIX are arranged in the matrix form, and each pixel is formed with a switching transistor Sw_Tr1 and a liquid crystal LIQ. Each protection circuit block ESD_BLK corresponds to the protection circuit block 3 shown in FIG. 1 and is formed with two diodes connected to each other in series provided between the ground (GND) and the VDD1 or VDD2, A point where the diodes are connected in series to each other is connected to an input terminal in the panel side, and this circuit prevents devices present inside the panel from being broken electrostatically.

A control signal transmitted from the external system passes through the protection circuit block ESD_BLK within the panel and is subjected to level shift by the level shift circuit block LS_BLK incorporated in the panel. The control signal having been subjected to the level shift controls operations of logic circuits in the gate driver G_DRV and the data driver DT_DRV. The controlled gate driver G_DRV sends a switching control signal to a drain electrode of the switching transistor Sw_Tr1. The controlled data driver D_DRV sends a data signal to a drain electrode of the switching transistor Sw_Tr1. When the switching transistor is ON, the data signal transmitted from the data driver DR_DRV is supplied to the liquid crystal LIQ.

The level shift circuit block LS_BLK used for level shifting is formed with a plurality of level shift circuits, and each level shift circuit has the same configuration as that of the first level shift circuit shown in FIG. 1. The terminals LSI_OUT and LSIX_OUT in the external system side 4 shown in FIG. 1 and the terminals P_IN and P_XIN (present on the panel side) corresponding the terminals LSI_OUT and LSIX_OUT correspond to a pair of terminals 19 shown in FIG. 9A and FIG. 9B as well as to a pair of the terminals T19 shown in FIG. 9C. Signals output to an external system from the terminals LSI_OUT and LSI_XOUT pass through the terminals P_IN and P_XIN and are input to the inside of the panel.

As described above, in the image display device according to the present embodiment, when the transistor size W/L is 50/4 or below, all of the devices constituting a level shift circuit operating with a low voltage and at a high speed can be incorporated in the panel, and the control line for connection between an external system and the image display panel can advantageously be realized with an input signal and an input inversion signal.

Second Embodiment

Figure 2:
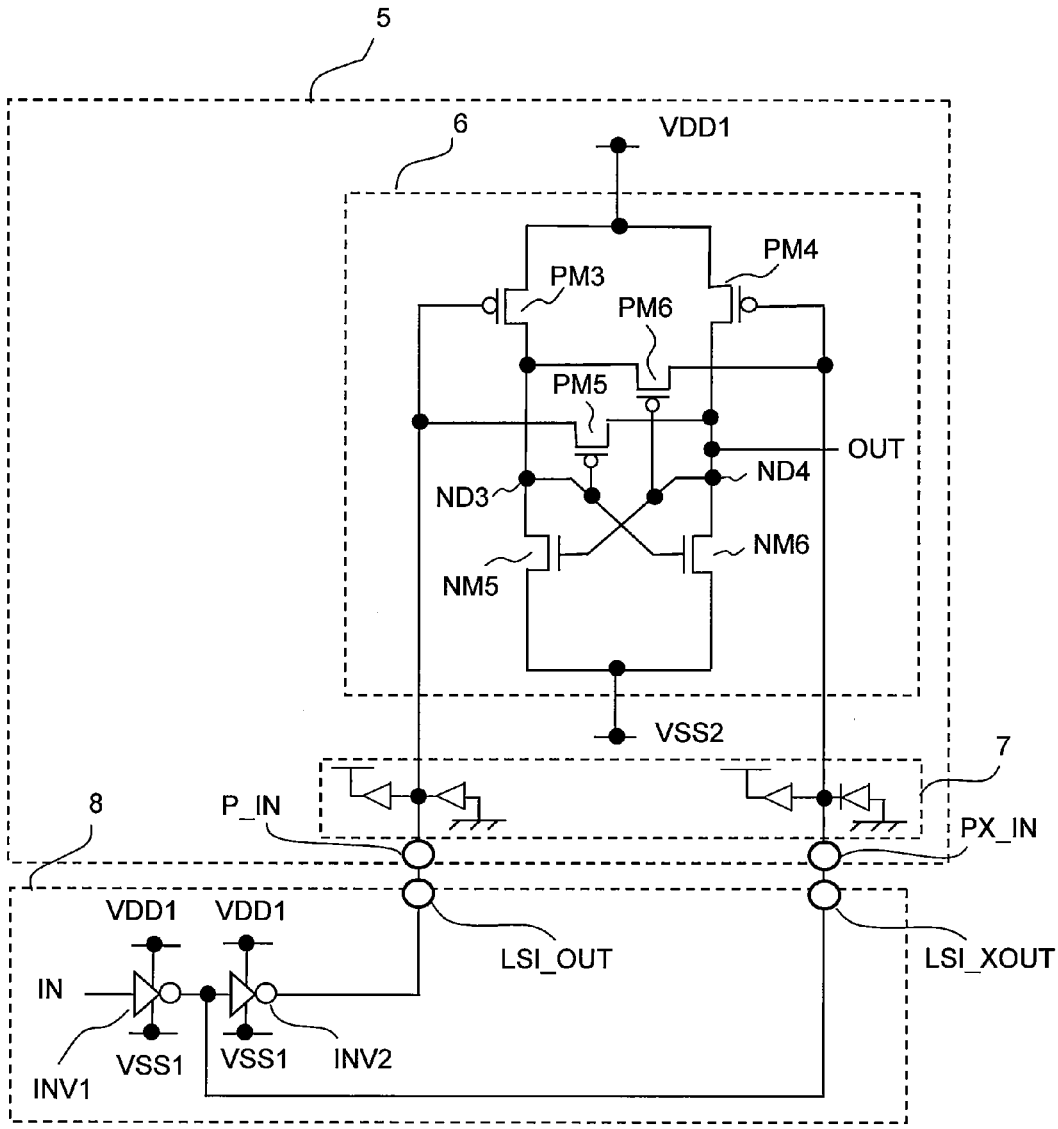
FIG. 2 is a block diagram illustrating a second level shift circuit used in an image display device according to the present invention.

In a second embodiment of the present invention, a second level shift circuit having the configuration shown in FIG. 2 is applied as a level shift circuit for the liquid crystal display system according to the first embodiment, and the configuration is different from that shown in FIG. 9A only in the level shift circuit. Therefore, the level shift circuit is mainly described below.

In FIG. 2, reference numeral 5 denotes an image display panel side; 6, a level shift circuit block; 7, a protection circuit block; and 8, an external system side. An input signal IN with the L level at VSS1 and the H level at VDD1, which is transmitted from an external system, is input from a LSI_OUT terminal of the external system side through a P_IN terminal of the panel side into the inside of the panel via inverters INV1 and INV2, while an inversion signal of the input signal IN is output via the inverter INV1 from the LSI_XOUT terminal of the external system side, passes through the P_XIN terminal of the panel side and is input into the inside of the panel. All devices including the NMOS transistors NM5, NM6 and PMOS transistors PM3, PM4, PM5, and PM 6 each constituting the level shift circuit block 6 are TFT devices formed on a glass substrate.

The second level shift circuit comprises a pair of NMOS transistors NM5, NM6 each having a source electrode connected to the lower voltage power source VSS2 or the ground (VSS2 in FIG. 2) and a gate electrode and a drain electrode (the gate electrode and the drain electrode of the NMOS transistor NM5 are cross coupled to the drain electrode and the gate electrode of the NM6, respectively); PMOS transistors PM3, PM4 each having a source electrode connected to the high power voltage VDD1, a drain electrode connected to a connection point for the cross-coupling, and a gate electrode (one of the gate electrodes of the PMOS transistors PM3, PM4 is connected with an input signal, and the other is connected with an input inversion signal); and PMOS transistors PM5, PM6 each having a gate electrode connected to a connection point for the cross-coupling and a drain electrode connected to a connection point for the cross-coupling, and a source electrode (one of the source electrodes of the PMOS transistors PM5, PM6 is connected with an input signal, and the other is connected to an input inversion signal). In the level shift circuit, the L level is at VSS2, and the H level is at VDD1. For the relation between VSS1 and VSS2, VSS2 is smaller than VSS1 (VSS2<VSS1).

Next, operations of the level shift circuit 6 having the configuration as described above are described below. In this level shift circuit 6, an input signal IN is applied to the gate electrode of the PMOS transistor PM3, and an inversion signal of the input signal is applied to the gate electrode of the PMOS transistor PM4 to operate the circuit.

In the following description, it is assumed that, in the initial state, the PMOS transistor PM3 and the NMOS transistor NM6 are in the not-conducting state and the PMOS transistor PM4 and the NMOS transistor NM5 are in the conducting state. When the input signal voltage falls and becomes lower than a threshold value for the PMOS transistor PM3, the PMOS transistor PM3 is set in the conducting state. At the same time, when the inversion signal voltage for the input voltage rises and becomes higher than a threshold value for the PMOS transistor PM4, the PMOS transistor PM4 is set in the not-conducting state. Since the NMOS transistor NM6 is shifted toward the conducting state according to a voltage at the node ND3 decided by a conduction resistance ratio between the PMOS transistor PM3 and the NMOS transistor NM5, a voltage at the node ND4 decided by a conduction resistance ratio between the PMOS transistor PM4 and the NMOS transistor NM6 is applied to the gate electrode of the PMOS transistor PM6, and an input inversion signal voltage is applied to the source electrode. In this state, since the PMOS transistor PM4 is in the not-conducting state, a voltage applied to the gate electrode of the PMOS transistor PM6 is sufficiently small and the input inversion signal is rising, so that a voltage applied to the source electrode of the PMOS transistor PM6 is sufficiently large, and therefore a sufficiently large voltage is applied to a section between the gate electrode and the source electrode of the PMOS transistor PM6.

Figure 7B:
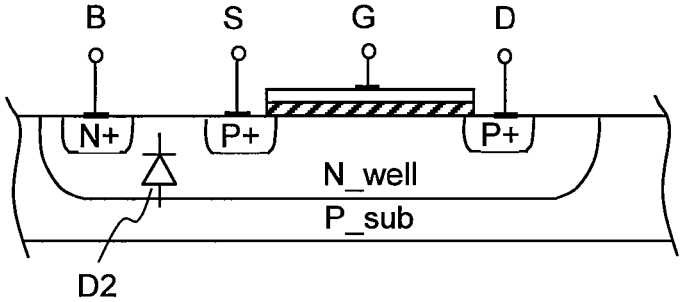
Figure 8A:
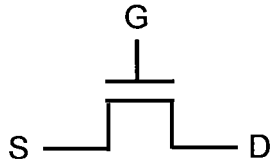
FIG. 8 s a view illustrating a TFT used for the image display device according to the present invention with a PMOS transistor symbol.
Figure 8B:
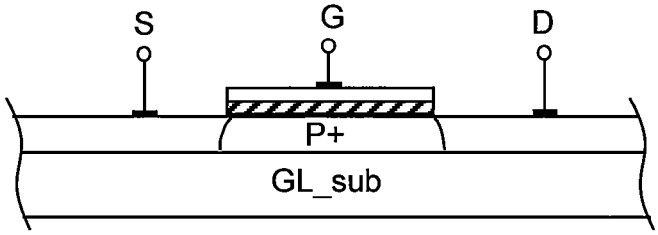

The PMOS transistor PM6 is a TFT device formed on a glass substrate which is an insulating body as shown in FIG. 8B, and a parasitic diode such as diode D2 as shown in FIG. 7B is not present, and the PMOS transistor PM6 is not affected by the substrate bias effect, so that the PMOS transistor PM6 can ensure a large drive capability with the transistor size W/L of 4/4.

A potential at the node ND3 can be shifted toward the H level according to a conduction resistance ratio between the PMOS transistor PM3 or PM6 and the NMOS transistor NM5. When the PMOS transistor PM6 is set in the conducting state where the drive capability is high, a potential value at the node ND4 falls toward the L level voltage (VSS2 in FIG. 2), so that the NMOS transistor NM5 is set in the not-conducting state, while a potential value at the node ND3 further rises toward the H level voltage (VDD1 in FIG. 2).

When the input signal voltage rises and becomes higher than a threshold value for the PMOS transistor PM3, the PMOS transistor PM3 is set in the not-conducting state. At the same time, when the inversion signal voltage for the input voltage falls and becomes lower than a threshold value for the PMOS transistor PM4, the PMOS transistor PM4 is set in the conducting state. Since the NMOS transistor NM5 is shifting toward the conducting state according to a voltage at the node ND4 decided by a conduction ratio between the PMOS transistor PM4 and the NMOS transistor NM6, a voltage at the node ND3 decided by a conduction resistance ratio between the PMOS transistor PM3 and the NMOS transistor NM5 is applied to the gate electrode of the PMOS transistor PM5, and the input signal voltage is applied to the source electrode.

In this state, since the PMOS transistor PM3 is in the not-conducting state, a voltage applied to the gate electrode of the PMOS transistor PM5 is sufficiently small, and the input signal is rising, so that a voltage applied to the source electrode of the PMOS transistor PM5 is sufficiently large, and therefore a sufficiently large voltage can be supplied to a section between the gate electrode and the source electrode of the PMOS transistor PM5.

The PMOS transistor PM5 is a TFT device formed on a glass substrate which is an insulating body as shown in FIG. 8B, and is not affected by the substrate bias effect, so that the PMOS transistor PM5 can ensure a large drive capability with the transistor size W/L of 4/4.

A potential at the node ND4 can be shifted toward the H level according to a conduction resistance ratio between the PMOS transistor PM4 or PM5 and the PMOS transistor PM5 realized through the operations as described above. When the NMOS transistor NM5 is set in the conducting state where the drive capability is high, a potential value at the node ND3 falls toward the L level voltage (VSS2 in FIG. 2), so that the PMOS transistor PM6 is set in the not-conducting state, and a potential value at the node ND4 further rises toward the H level (VDD1 in FIG. 2).

That is, the second level shift circuit shown in FIG. 2 functions as a level shift circuit which converts a low amplitude signal transmitted from the external system side circuit 8 using the power voltage VDD1 and the low voltage source VSS1 to a high amplitude signal and transmits the high amplitude signal to a circuit using the high power voltage VDD1 and the low voltage source VSS2.

In this embodiment, when the reference voltage VDD1 is shared and a high voltage source VSS1 and a low voltage source VSS2 are present, like in the first embodiment, all devices constituting a level shift circuit capable of operating at a low voltage and at a high speed with the transistor size W/L of 50/4 can be incorporated within a panel, and a control line for connection between an external system and an image display panel can advantageously be realized with an input signal and an input inversion signal.

Third Embodiment

Figure 9B:
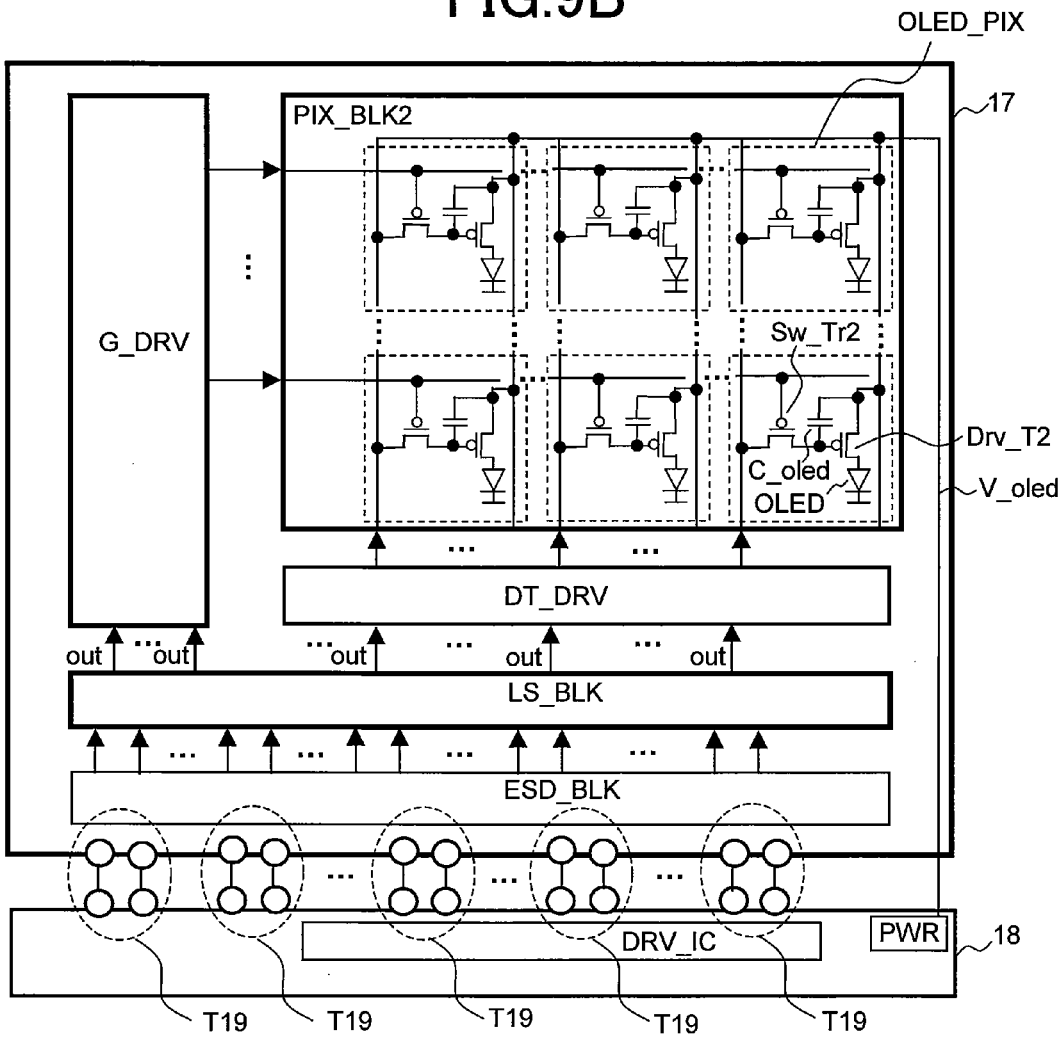
FIG. 9B is a block diagram illustrating an organic LE image display device according to first and fourth embodiments of the present invention.
Figure 9C:
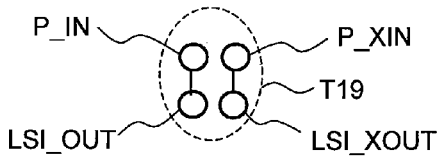
FIG. 9C is a view illustrating a correspondence between terminals of a level shift circuit and those of an image display device.

In a third embodiment of the present invention, a first level shift circuit is applied as a level shift circuit of the organic EL image display system shown in FIG. 9B. In the image display system shown in FIG. 9B, a configuration inside a panel 17 is the same as that shown in FIG. 9A excluding a configuration of the pixel block PIX_BLK2 and the necessity for a power supply line Voled for supplying driving power to a current-driven light-emitting device using an organic EL (described as OLED hereinafter). Furthermore a configuration of the external system side 18 is the same as that shown in FIG. 9A excluding the point that a power PWR is required for supplying a voltage to the power supply line Voled.

In the pixel block PIX_BLK2, each of pixels OLED_PIX arranged in the matrix form includes a switching a transistor Sw_Tr2, a light-emitting device OLED, a drive transistor Drv_T2 for the light-emitting device OLED, and a capacitor C_oled for storing therein data, and a power supply line Voled is required for supplying a current to the light-emitting device OLED. A level shift circuit used for level shift is the first level shift circuit shown in FIG. 1, and operations of the first level shift circuit were already described above, so that description of the operations is omitted herefrom. Also in the image display system according to this embodiment, like in the first embodiment, all of devices constituting the level shift circuit operating under a low voltage at a high speed are incorporated within the panel with the transistor size W/L of 50/4 or below. In this embodiment, a control line for connection between an external system and the image display panel can advantageously be realized with an input signal and an input inversion signal and the power supply line Voled.

Fourth Embodiment

In this embodiment, the second level shift circuit shown in FIG. 2 is applied to the organic EL image display system shown in FIG. 9B. Therefore, the configuration is different from that of the organic EL image display system described in the third embodiment only in the configuration of the level shift circuit block LS_BLK. Operations of the second level shift circuit are the same as those described in the second embodiment, and therefore detailed description thereof is omitted. The second level shift circuit operates in a voltage range from VSS2 as the L level and VDD1 as the H level (VSS2<VSS1), and converts a low amplitude signal transmitted from a circuit using the power voltage VDD1 and the lower voltage source VSS1 to a high amplitude signal, and transmits the high amplitude signal to a circuit using the high power voltage VDD1 and the low voltage source VSS2.

Therefore, in the fourth embodiment, when the reference voltage VDD1 is shared and the high voltage source VSS1 and the low voltage source VSS2 are used like in the second embodiment, all of devices constituting a level shift circuit operating under a low voltage at a high speed can be incorporated within a panel with the transistor size W/L of 50/4 or below, and the control line for connection between an external system and the image display panel can advantageously be realized with an input signal, an input inversion signal, and the power supply line Voled.

Fifth Embodiment

Figure 3:
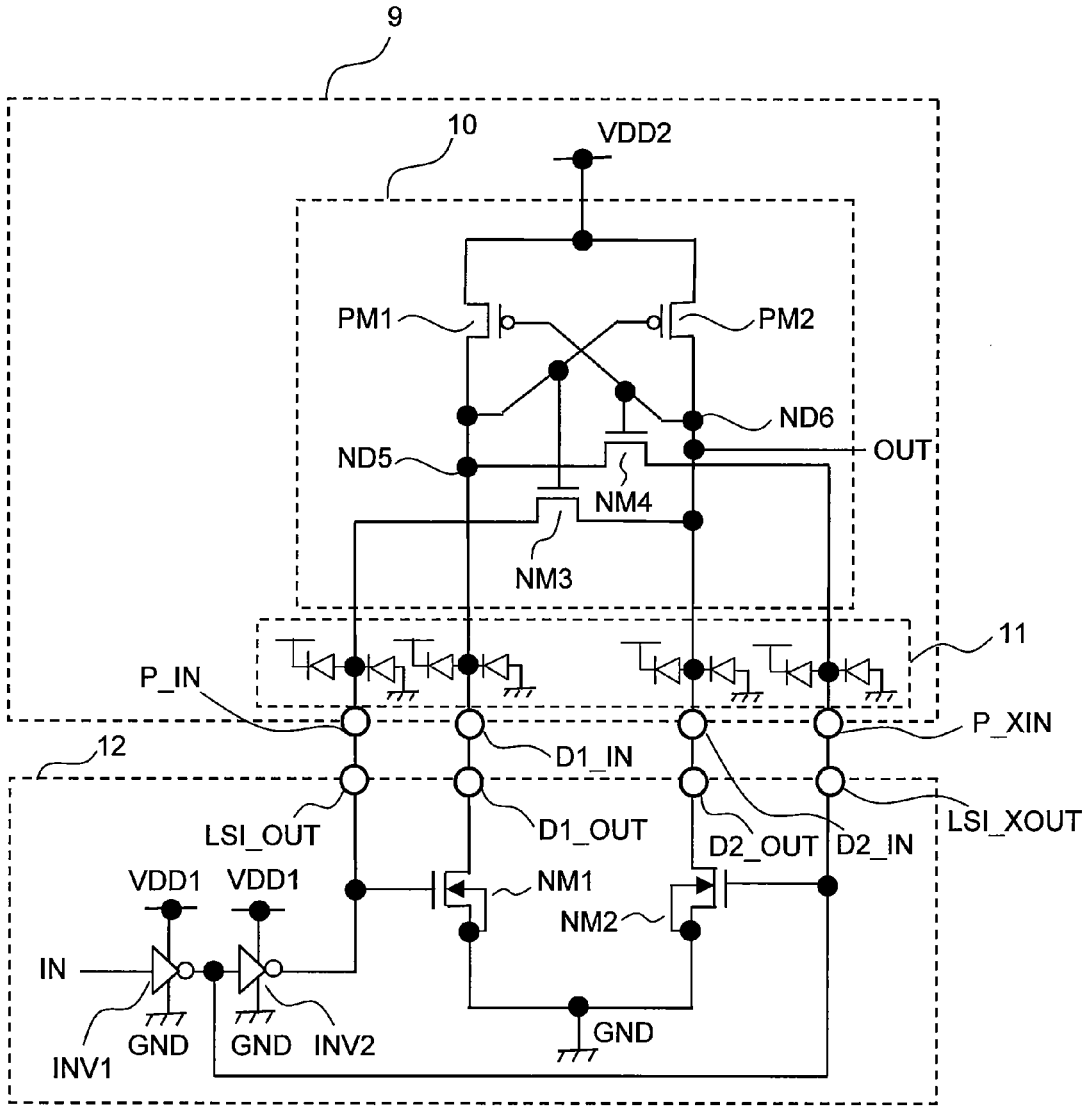
FIG. 3 is a block diagram illustrating a third level shift circuit used in an image display device according to the present invention.
Figure 10A:
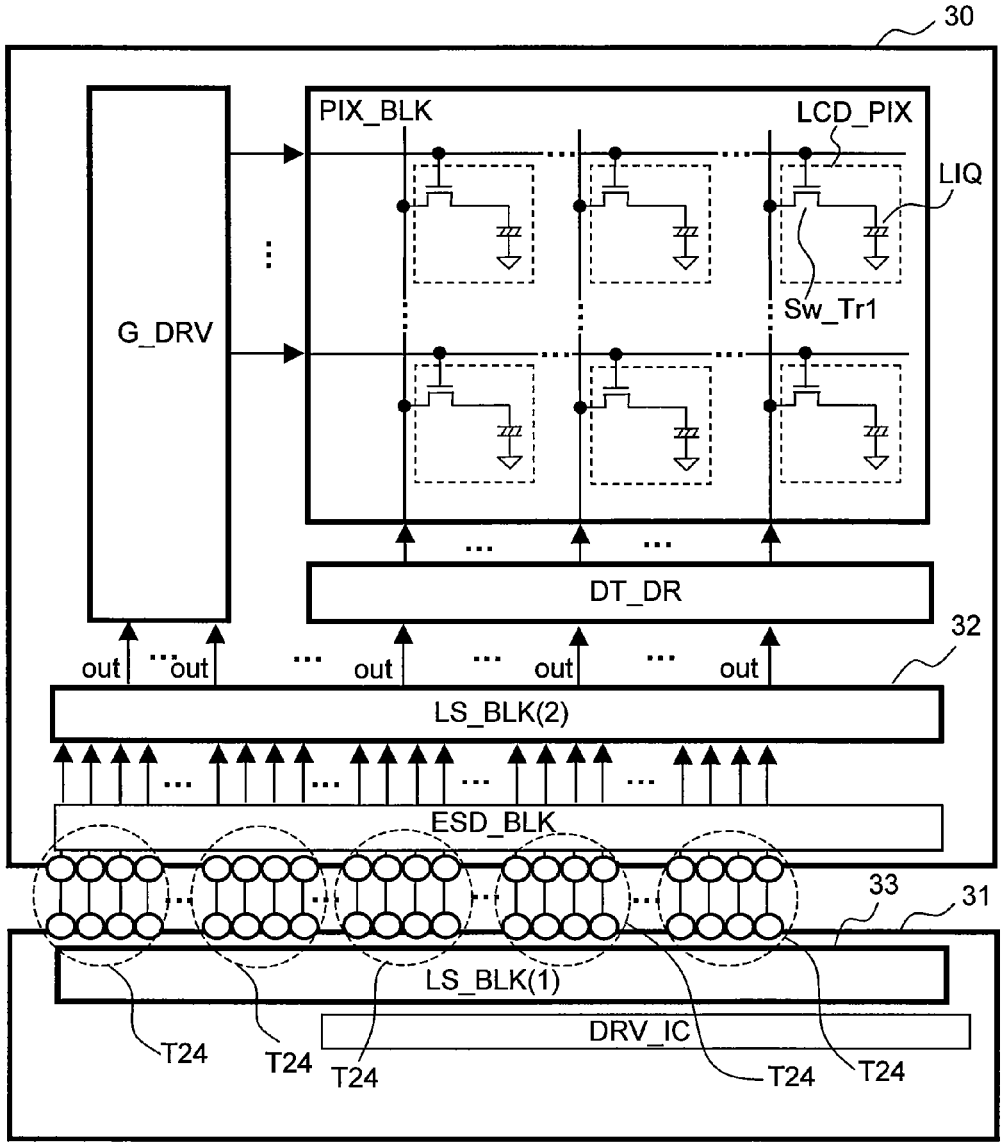
FIG. 10A is a block diagram illustrating a liquid crystal image display device according to fifth and sixth embodiments of the present invention.

In a fifth embodiment of the present invention, the third level shift circuit shown in FIG. 3 is applied in the liquid crystal image display system shown in FIG. 10A. A configuration of the liquid crystal display system shown in FIG. 10A is different from that shown in FIG. 9A in that a level shift circuit block LS_BLK (1), which is a portion of the level shift circuit, is arranged within an LSI chip 33 in an external system side 31, and a level shift circuit block LS BLK (2) is arranged so that a protection circuit block ESD_BLK in the panel is located between the level shift circuit blocks LS_BLK (1) and LS_BLK (2) and in that the number of terminals T4 for connection between the panel 30 and the external system 31 increases because of the arrangement as described above. Otherwise, the configuration shown in FIG. 10A is substantially the same as that shown in FIG. 9A.

The third level shift circuit is described below. In FIG. 3, the NMOS transistors NM1, NM2 are monocrystal silicon semiconductor devices as shown in FIG. 5B, and are incorporated in an LSI chip in the external system. The PMOS transistors PM1, PM2 are TFT devices each having the structure as shown in FIG. 8B, while the NMOS transistors NM3, NM4 are TFT devices each having the structure as shown in FIG. 6B. The configuration of the third level shift circuit is different from that of the first level shift circuit in that the third level shift circuit is formed on a glass substrate (GL_sub) which is an insulating body. Otherwise, the configuration of the third level shift circuit is substantially the same as that of the first level shift circuit.

In FIG. 3, reference numeral 9 denotes an image display panel side; 10, the configuration of a level shift circuit block; 11, the configuration of a protection circuit block; and 12, an external system side. An input signal with the GND as the L level and VDD1 as the H level, which is transmitted from the external system, and an inversion signal of the input signal are output from the external system via the terminals of LSI_OUT, LSI_XOUT, D1_OUT, and D2_OUT and are input into the inside of the panel through the terminals P_IN, P_XIN, DL_IN, and D2_IN.

Operations of the third level shift circuit are the same as those of the first level shift circuit described in the first embodiment 1. Even when the NMOS transistors NM1, NM2 shown in FIG. 3 are each configured with a monocrystal silicon semiconductor device, since voltages at the source electrode and the gate electrode are always kept constant, the parasitic diode D1 as shown in FIG. 5B is not generated and therefore the circuit is not affected by the substrate bias effect. Furthermore, a threshold value for the monocrystal silicon semiconductor transistor is smaller than a threshold value for a transistor formed on an insulating substrate, and a high speed level shift circuit operating under the low voltage VDD1 can advantageously be realized without the necessity of making larger the transistor size W/L more easily as compared to a case in which a transistor having a gate electrode with an input signal or an input inversion signal connected thereto is realized with a TFT device.

Sixth Embodiment

Figure 4:
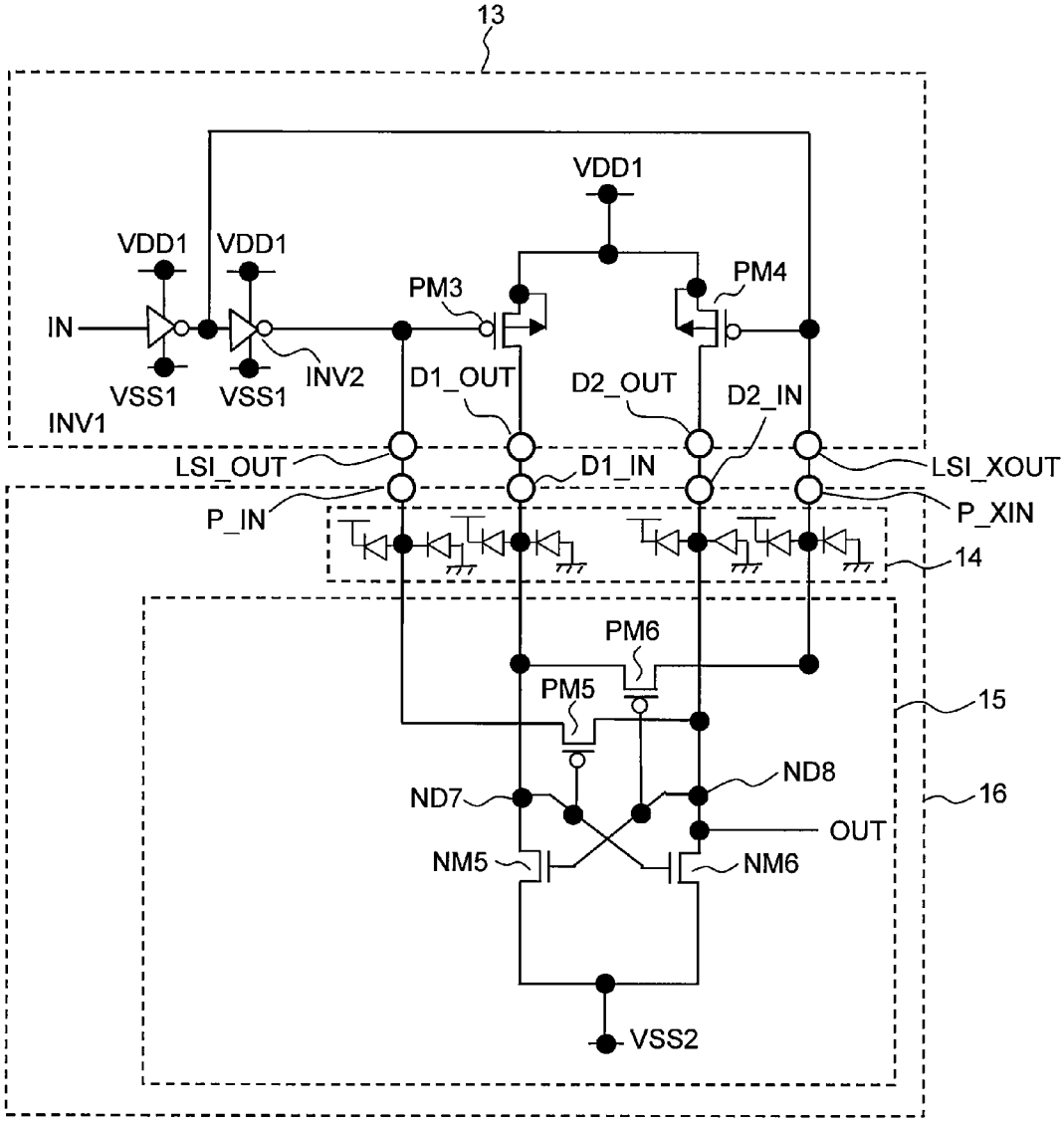
FIG. 4 is a block diagram illustrating a fourth level shift circuit used in an image display device according to the present invention.

In a sixth embodiment of the present invention, the fourth level shift circuit shown in FIG. 4 is applied to the liquid crystal image display system shown in FIG. 10A. The liquid crystal image display system according to this embodiment is basically the same as that according to the fifth embodiment, but is different from the fifth embodiment only in that the fourth level shift circuit is used for shifting a level.

The fourth level shift circuit is described below. The PMOS transistors PM3, PM4 are monocrystal silicon semiconductor devices each having the structure as shown in FIG. 7B and are incorporated within an LSI chip of an external system. The PMOS transistors PM5, PM6 are TFT devices each having the structure as shown in FIG. 8B, and the NMOS transistors NM5, NM6 are TFT devices each having the structure as shown in FIG. 6B. The fourth level shift circuit is different from the second level shift circuit shown in FIG. 2 in the point that the fourth circuit is formed on a glass substrate which is an insulating body. Other portions of the configuration are the same as those of the configuration shown in FIG. 2.

Figure 14:
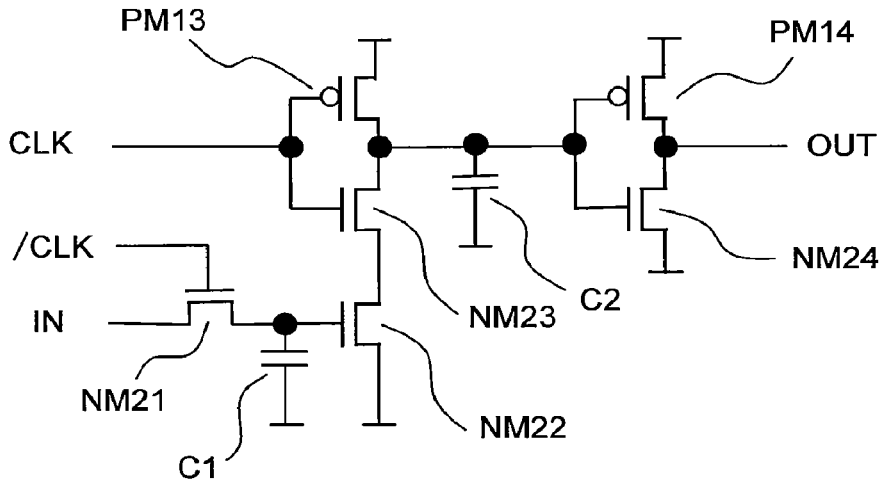
PRIOR ART FIG.14
FIG. 14 is an explanatory view illustrating still another configuration (3) of the conventional level shift circuit.

In FIG. 14, reference numeral 16 denotes an image display panel side; 15, the configuration of a level shift circuit block; and 14 the configuration of a protection circuit block. Reference numeral 13 denotes a system side. An input signal with the L level at VSS1 and the H level at VDD1, which is transmitted from an external system, and an inversion signal for the input signal are output via the terminals LSI_OUT, LSI_XOUT, D1_OUT, and D2_OUT from the external system, and input via the terminals P_IN, P_XIN, D1_IN, and D2_IN into the inside of the panel.

Operations of the fourth level shift circuit according to this embodiment are the same as those of the second level shift circuit described in the second embodiment, and therefore description thereof is omitted herein. Even when the PMOS transistors PM3, PM4 are each configured with a monocrystal silicon semiconductor device, since voltages at the source electrode and the gate electrodes are always kept constant, the parasitic diode D2 as shown in FIG. 7B is not generated, so that the circuit is not affected by the substrate bias effect. In the fourth level shift circuit according to this embodiment, the reference voltage VDD1 is shared and there are the high voltage source VSS1 and the low voltage source VSS2 each as a source of a voltage lower than the VDD1, a high speed level shift circuit operating with the low voltage source VDD1 can be realized without the necessity of making larger the transistor size W/L like in the fifth embodiment.

Seventh Embodiment

Figure 10B:
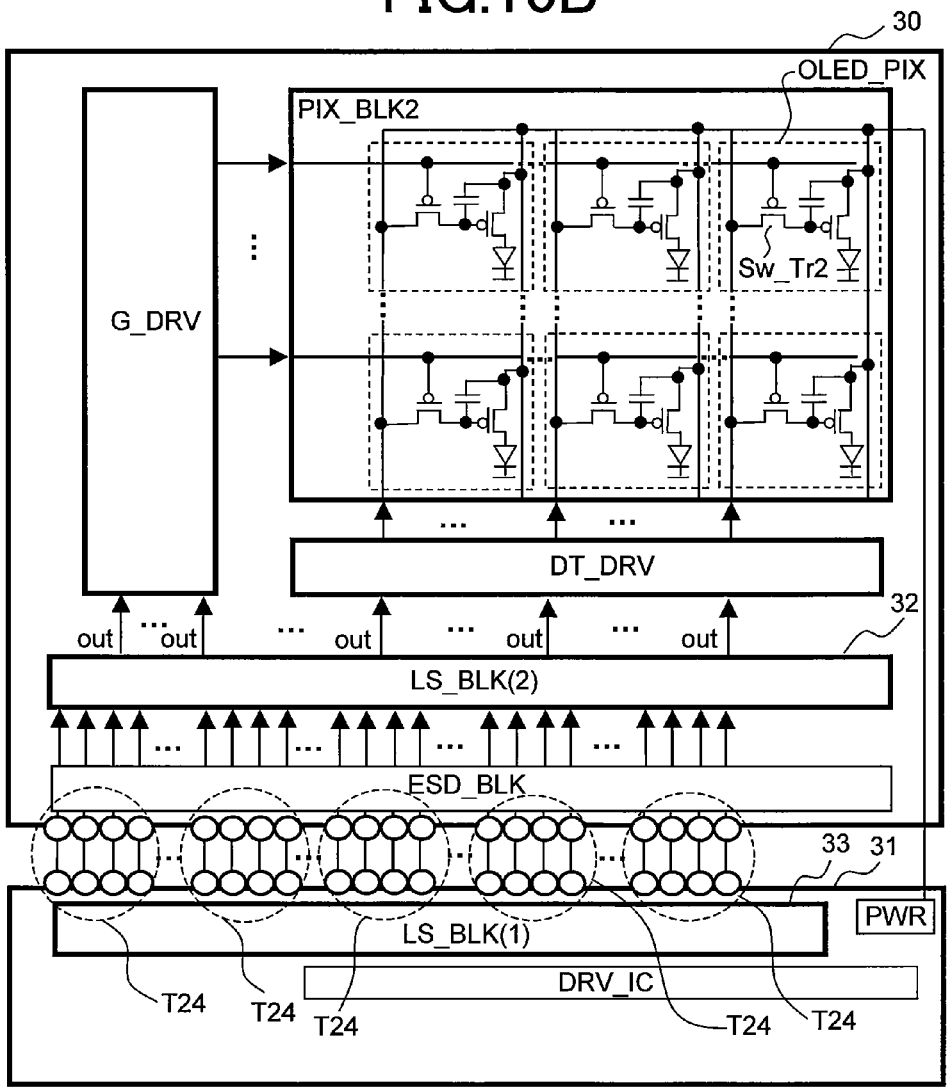
FIG. 10B is a block diagram illustrating an organic EL image display device according to seventh and eighth embodiments of the present invention.
Figure 10C:
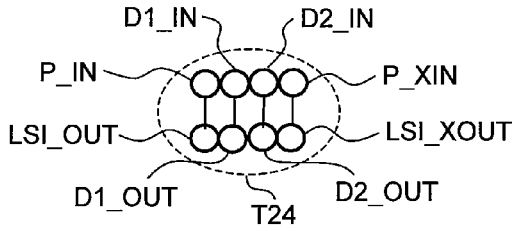
FIG. 10C is a view illustrating a correspondence between terminals of a level shift circuit and those in an image display device.
Figure 11:
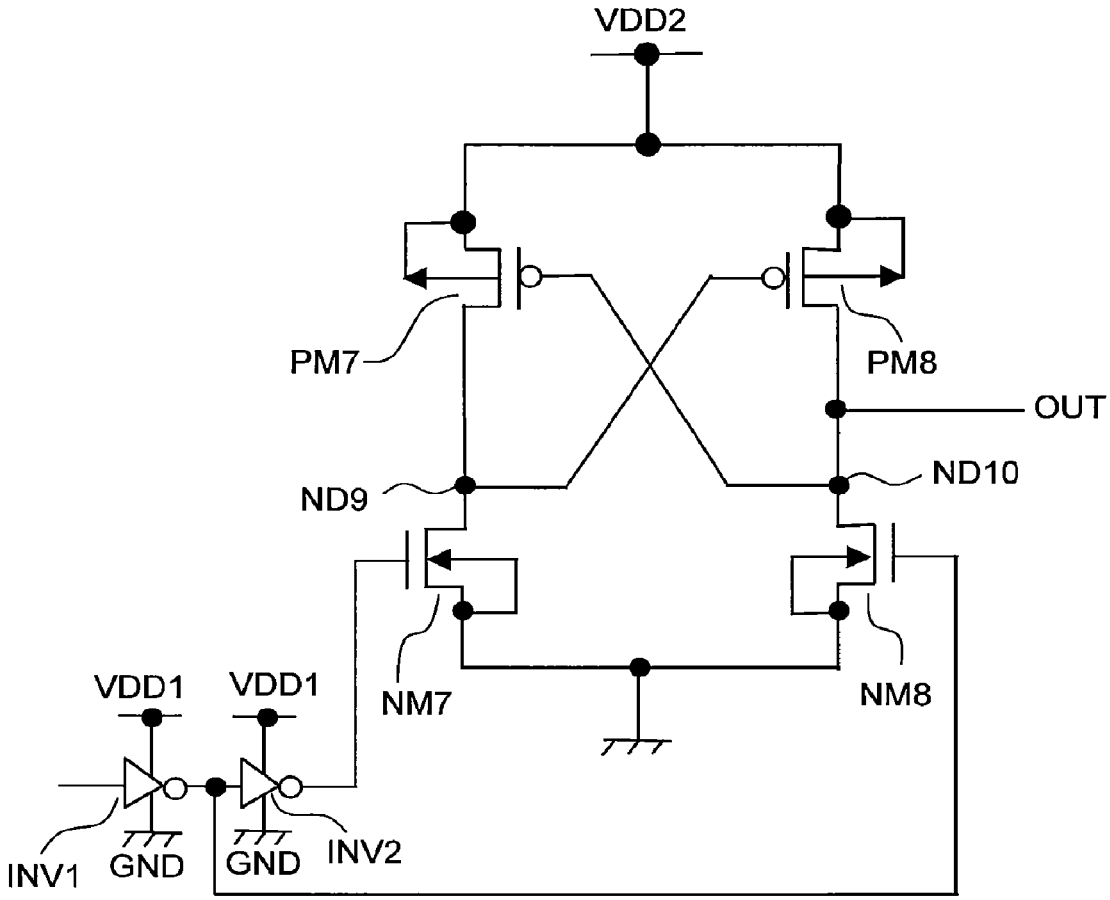
FIG. 11 is a general circuit block diagram of a level shift circuit provided outside a display panel.
Figure 12A:
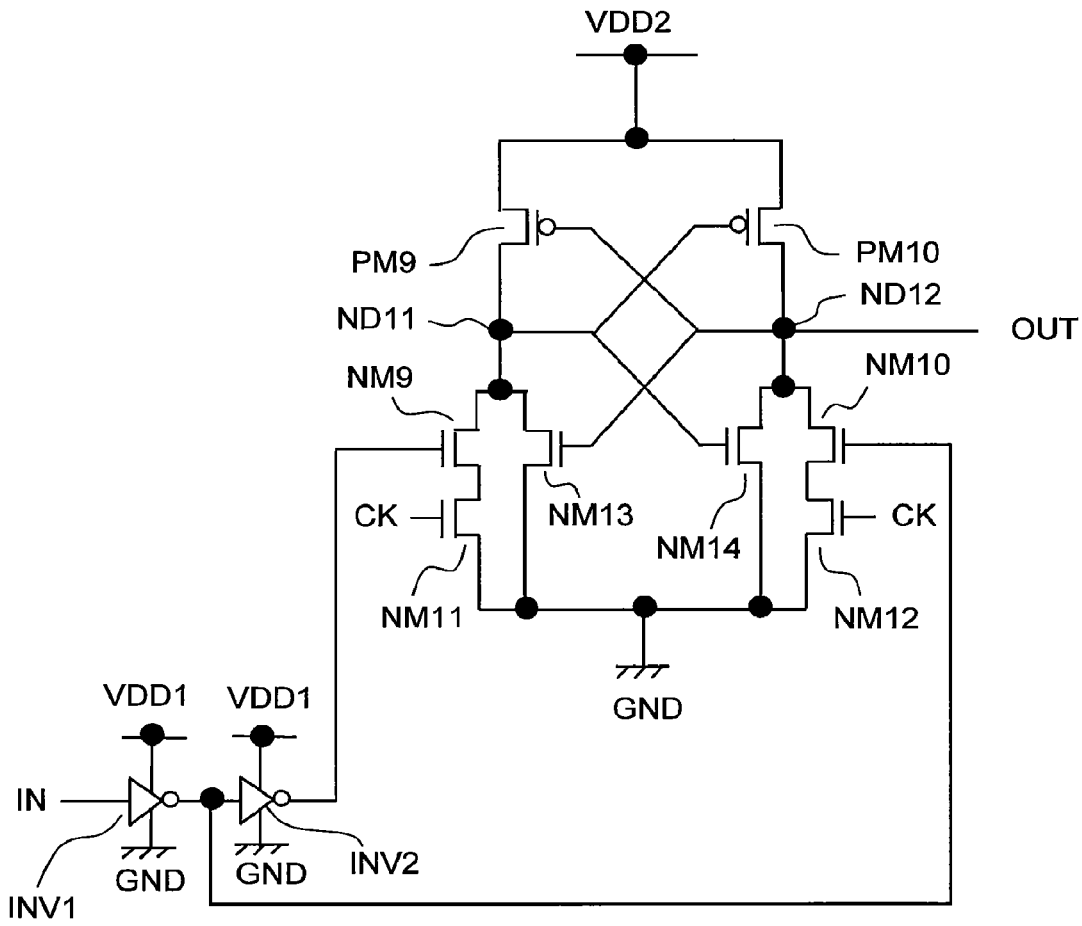
PRIOR ART FIG.12A
FIG. 12A is a block diagram of a conventional level shift circuit.
Figure 12B:
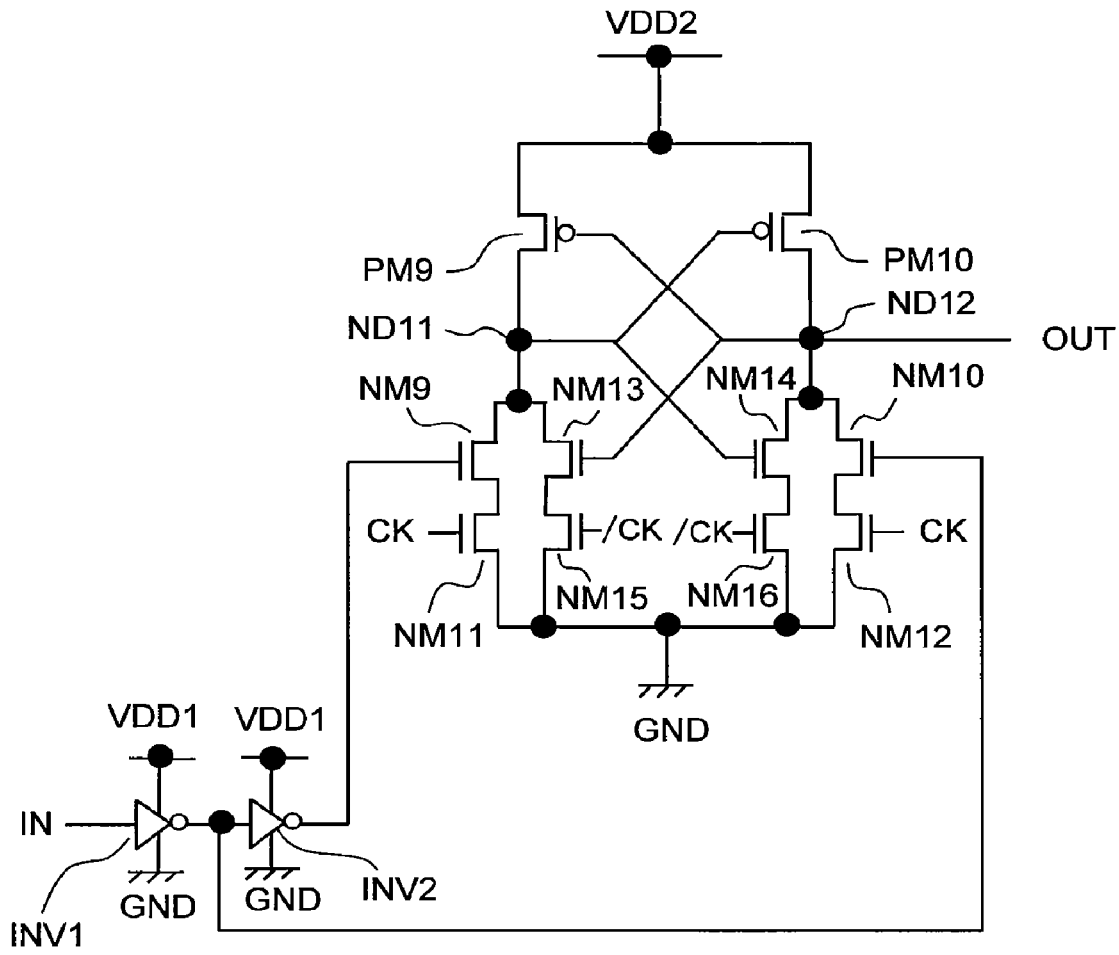
FIG. 12B is another block diagram of a conventional level shift circuit.
Figure 13:
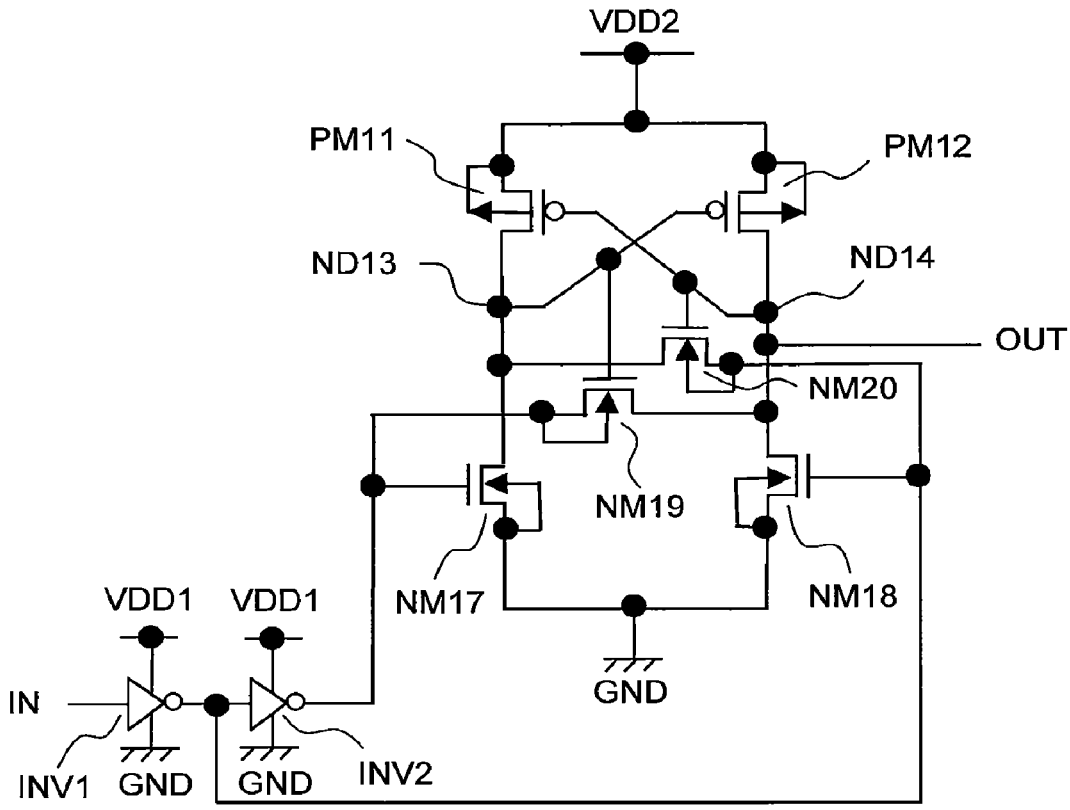
PRIOR ART FIG.13
FIG. 13 is still another block diagram of a conventional level shift circuit.

In a seventh embodiment of the present invention, the third level shift circuit is applied to the organic EL image display system shown in FIG. 10B. The image display system shown in FIG. 10B is different from that shown in FIG. 9A in that a portion of the level shift circuit block LS_BLK (1) is arranged within an LSI chip 33 of the external system, and the remaining level shift circuit block LS_BLK (2) is arranged so that a protection circuit block ESD_BLK within the panel 30 is located between the level shift circuit blocks LS_BLK (1) and (2), and in that the number of terminals 24 for connection between the panel 30 and the external system 31 increases because of the arrangement. Other portions of the configuration is the same as that shown in FIG. 9B. The correspondence between the terminals in the panel side and the external system side in the third and fourth level shift circuits shown in FIG. 3 and FIG. 4 and those (terminals 24) in FIG. 10A and FIG. 10B is shown in FIG. 10C.

In the first level shift circuit, the NMOS transistors NM1, NM2 are, as described in the fifth embodiment, monocrystal silicon semiconductor devices as shown in FIG. 5B, and are incorporated in an LSI chip of the external system. The PMOS transistors PM1, PM2 are TFT devices each having the structure as shown in FIG. 8B, and the NMOS transistors NM3, NM4 are TFT devices each having the structure as shown in FIG. 6B. The third level shift circuit is formed on a glass substrate (GL_sub) which is an insulating body, and a configuration and operations of the third level shift circuit according to the seventh embodiment are the same as those of the third level shift circuit described in the fifth embodiment.

Therefore, also in this embodiment, when the reference VDD1 is shared and there are the high voltage source VSS1 and the low voltage source VSS2 each providing a voltage lower than the reference voltage VDD1, a high speed level shift circuit operating under the low voltage VDD1 can advantageously be formed without the necessity of making larger the transistor W/L like in the fifth embodiment.

Eighth Embodiment

In an eighth embodiment of the present invention, the fourth level shift circuit is applied to the organic EL image display system. The eighth embodiment is different from the seventh embodiment in the level shift circuit. Operations of the fourth level shift circuit are the same as those of the second level shift circuit as described in the sixth embodiment.

Also in this embodiment, even when the PMOS transistors PM3, PM4 are formed each with a monocrystal silicon semiconductor device, because voltages at the source electrode and at the gate electrode are always kept constant like in the sixth embodiment, the parasitic diode D2 as shown in FIG. 7B does not operate, and the circuit is not affected by the substrate bias effect. Also in the fourth level shift circuit used in the organic EL image display system according to this embodiment, when the reference VDD1 is shared and there are the high voltage source VSS1 and the low voltage source VSS2 each functioning a voltage source for providing a voltage lower than the reference voltage, a high-speed level shift circuit operating under the low voltage VDD1 can advantageously be realized without the necessity of making larger the transistor size W/L.

What is claimed is:

1. An image display device comprising:

a pixel block having a plurality of pixel circuits arranged on an image display panel in a matrix form;

a gate driver section which generates a signal for scanning each of the pixel circuits;

a data driver section which supplies a video signal via a data signal line to each of the pixel circuits;

a protection circuit block; and a level shift circuit which converts a low amplitude signal to a high amplitude signal and which transmits the high amplitude signal to the gate driver section and the data driver section, wherein the level shift circuit includes a first PMOS transistor and a second PMOS transistor each having a source electrode connected to a power voltage and a gate electrode and a drain electrode, the gate electrode of the first PMOS transistor being connected to the drain electrode of the second PMOS transistor, the drain electrode of the first PMOS transistor being connected to the gate electrode of the second PMOS transistor;

a first NMOS transistor having a source electrode connected to ground, a drain electrode connected to the drain electrode of the first PMOS transistor via the protection circuit block, and a gate electrode connected to an input terminal;

a second NMOS transistor having a source electrode connected to ground, a drain electrode connected to the drain electrode of the second PMOS transistor via the protection circuit block, and a gate electrode connected to an input inverting terminal;

a third NMOS transistor having a gate electrode connected to the drain electrode of the first NMOS transistor via the protection circuit block and to the drain electrode of the first PMOS transistor, a drain electrode connected to the drain electrode of the second NMOS transistor via the protection circuit block, and a source electrode connected to the gate electrode of the first NMOS transistor via the protection circuit block; and a fourth NMOS transistor having a gate electrode connected to the drain electrode of the second NMOS transistor via the protection circuit block and to the drain electrode of the second PMOS transistor, a drain electrode connected to the drain electrode of the first NMOS transistor via the protection circuit block, and a source electrode connected to the gate electrode of the second NMOS transistor via the protection circuit block, wherein the pixel block, the gate driver section, the data driver section, the protection circuit block, the first and second PMOS transistors, and the third and fourth NMOS transistors are comprised of TFT devices formed on a glass substrate, and wherein the first and second NMOS transistors are monocrystal silicon semiconductor devices formed on a semiconductor substrate.

2. An image display device comprising:

a pixel block having a plurality of pixel circuits arranged on an image display panel in the matrix form;

a gate driver section which generates a signal for scanning each of the pixel circuit;

a data driver section which supplies a video signal via a data signal line to each of the pixel circuits;

a protection circuit block; and a level shift circuit which converts a low amplitude signal to a high amplitude signal and which transmits the high amplitude signal to the gate driver section and the data driver section, wherein the level shift circuit includes a first NMOS transistor and a second NMOS transistor each having a source electrode connected to a low voltage source, a gate electrode and a drain electrode, the gate electrode of the first NMOS transistor being connected with the drain electrode of the second NMOS transistor, the drain electrode of the first NMOS transistor being connected with the gate electrode of the second NMOS transistor;

a first PMOS transistor having a source electrode connected to a high voltage source, a drain electrode connected to the drain electrode of the first NMOS transistor via the protection circuit block, and a gate electrode connected to an input terminal;

a second PMOS transistor having a source electrode connected to the high voltage source, a drain electrode connected to the drain electrode of the second NMOS transistor via the protection circuit block, and a gate electrode connected to an input inverting terminal;

a third PMOS transistor having a gate electrode connected to the drain electrode of the first PMOS transistor via the protection circuit block and to drain electrode of the first NMOS transistor, a drain electrode connected to the drain electrode of the second PMOS transistor via the protection circuit block, and a source electrode connected to the gate electrode of the first NMOS transistor via the protection circuit block; and a fourth PMOS transistor having a gate electrode connected to the drain electrode of the second PMOS transistor via the protection circuit block and to the drain electrode of the second NMOS transistor, a drain electrode connected to the drain electrode of the second PMOS transistor via the protection circuit block, and a source electrode connected to the gate electrode of the second PMOS transistor via the protection circuit block, wherein the pixel block, the gate driver section, the data driver section, the protection circuit block, the first and second NMOS transistors, and the third and fourth PMOS transistors are comprised of TFT devices formed on a glass substrate, and wherein the first and second PMOS transistors are monocrystal silicon semiconductor devices formed on a semiconductor substrate.

3. The image display device according to claim 1, wherein sizes W/L of the transistors constituting a circuit are 50/4 or below.

4. The image display device according to claim 1, wherein a transistor used in the image display panel is a TFT.

5. The image display device according to claim 1, wherein each of pixel circuits arranged in a matrix form in the pixel block includes:

a switching transistor;

a liquid crystal;

a data signal line for supplying a video signal to the liquid crystal when the switching transistor is ON; and a gate signal line for supplying a scanning signal to a gate electrode of the switching transistor.

6. The image display device according to claim 1, each of the pixel circuits arranged in a matrix form in the pixel block comprises:

a switching transistor;

a current-driven light-emitting device;

a drive transistor for the current-driven light-emitting device;

a data signal line for supplying a video signal to a gate electrode of the drive transistor for the current-driven light-emitting device when the switching transistor is ON;

a gate signal line for supplying a scanning signal to a gate electrode of the switching transistor;

a power supply line for supplying a drive current to the current-driven light-emitting device; and a capacitor for storing therein data.

7. The image display device according to claim 1, wherein the input signal includes:

a driver control signal that is generated by a circuit formed with a monocrystal silicon semiconductor device and that is supplied via the level shift circuit to a gate driver section; and a data driver control signal that is generated by a circuit formed with a monocrystal silicon semiconductor device and that is supplied via the level shift circuit to the data driver section.

8. The image display device according to claim 1, wherein a video signal supplied through the data signal line is supplied via a driver IC, the level shift circuit and the data driver section to the pixel circuit.

9. The image display device according to claim 2, wherein sizes W/L of the transistors constituting a circuit are 50/4 or below.

10. The image display device according to claim 2, wherein a transistor used in the image display panel is a TFT.

11. The image display device according to claim 2, wherein each of the pixel circuits arranged in a matrix form comprises:

a switching transistor;

a liquid crystal;

a data signal line for supplying a video signal to the liquid crystal when the switching transistor is ON; and a gate signal line for supplying a scanning signal to a gate electrode of the switching transistor.

12. The image display device according to claim 2, wherein each of the pixel circuits arranged in a matrix form comprises:

a switching transistor;

a current-driven light-emitting device;

a drive transistor for the current-driven light-emitting device;

a data signal line for supplying a video signal to a gate electrode of the driver transistor when the switching transistor is ON;

a gate signal line for supplying a scanning signal to a gate electrode of the switching transistor;

a power supply line for supplying a drive current to the current-driven light-emitting device; and a capacitor for storing data therein.

13. The image display device according to claim 2, the input signal includes:

a gate driver control signal that is generated by a circuit formed with a monocrystal silicon semiconductor device and that is supplied via the level shift block to the gate driver section; and a data driver control signal that is generated by a circuit formed with a monocrystal silicon semiconductor device and that is supplied via the level shift block to the data driver section.

14. The image display section according to claim 2, wherein a video signal supplied through the data signal line is supplied via a driver IC, the level shift block and the data driver section to the pixel circuit.

* * * * *